US007744368B2

(12) United States Patent
Frigiere et al.

(10) Patent No.: US 7,744,368 B2
(45) **Date of Patent: *Jun. 29, 2010**

(54) MULTI-MODE LIGHTER

(75) Inventors: Rene D. Frigiere, Allaire (FR); Paul Adams, Monroe, CT (US); Anthony Sgroi, Jr., Wallingford, CT (US)

(73) Assignee: BIC Corporation, Shelton, CT (US)

( * ) Notice: Subject to any disclaimer, the term of this patent is extended or adjusted under 35 U.S.C. 154(b) by 1331 days.

This patent is subject to a terminal disclaimer.

(21) Appl. No.: 11/221,295

(22) Filed: Sep. 6, 2005

(65) Prior Publication Data

US 2006/0073432 A1 Apr. 6, 2006

Related U.S. Application Data

(60) Continuation-in-part of application No. 11/145,306, filed on Jun. 3, 2005, now Pat. No. 7,070,408, which is a division of application No. 10/389,975, filed on Mar. 18, 2003, now Pat. No. 6,908,302, which is a continuation-in-part of application No. 10/085,045, filed on Mar. 1, 2002, now Pat. No. 6,726,469, which is a continuation-in-part of application No. 09/817,278, filed on Mar. 27, 2001, now Pat. No. 6,916,171, and a continuation-in-part of application No. 09/819,021, filed on Mar. 27, 2001, now Pat. No. 6,488,492, which is a continuation-in-part of application No. 09/704,689, filed on Nov. 3, 2000, now Pat. No. 6,491,515.

(51) Int. Cl.
*F23Q 2/00* (2006.01)

(52) U.S. Cl. ..... 431/153; 431/255

(58) Field of Classification Search ..... 431/153, 431/254, 255
See application file for complete search history.

(56) References Cited

U.S. PATENT DOCUMENTS

| | | | |
|---|---|---|---|
| 2,498,377 | A | 2/1950 | Nissen |
| 3,540,823 | A | 11/1970 | Ebine et al. |
| 3,758,820 | A | 9/1973 | Lohberg |
| 4,022,566 | A | 5/1977 | Goto |
| 4,259,059 | A | 3/1981 | Roosa et al. |
| 4,462,791 | A | 7/1984 | Hayden |
| 4,870,314 | A | 9/1989 | Hefling |
| 4,921,420 | A | 5/1990 | Johnston |

(Continued)

*Primary Examiner*—Alfred Basichas
(74) *Attorney, Agent, or Firm*—Jones Day

(57) ABSTRACT

The present invention relates to a lighter which a user actuates by at least two different modes of operation. In the first mode, a plunger member is positioned to allow a biasing member to oppose movement of an actuating assembly so that a user releases fuel and ignites the lighter only if a high-actuation-force is applied to the actuator. In this first mode, the lighter resists operation by unintended users by requiring a user to have a predetermined level of strength to actuate the lighter. In the second mode, the plunger member is moved to a different position so that the biasing member does not oppose movement of the actuating assembly to the same extent as the first mode so that a user may release fuel and ignite the lighter if a low-actuation-force is applied to the actuator. Moving the plunger member from the first position to the second position preferably requires the user to have a predetermined level of cognitive abilities and/or physical characteristics in order to resist use by unintended users.

18 Claims, 17 Drawing Sheets

U.S. PATENT DOCUMENTS

| | | | | |
|---|---|---|---|---|
| 5,145,358 | A | 9/1992 | Shike et al. | |
| 5,199,865 | A | 4/1993 | Liang | |
| 5,262,697 | A | 11/1993 | Meury | |
| 5,334,011 | A | 8/1994 | Frigiére | |
| 5,462,432 | A | 10/1995 | Kim | |
| 5,496,169 | A | 3/1996 | Chen | |
| 5,520,197 | A | 5/1996 | McDonough et al. | |
| 5,531,591 | A | 7/1996 | Yamazaki | |
| 5,645,414 | A | 7/1997 | Wang | |
| 5,697,775 | A | 12/1997 | Saito et al. | |
| 5,854,530 | A | 12/1998 | LaForest et al. | |
| 5,897,308 | A | 4/1999 | Saito et al. | |
| 5,934,895 | A | 8/1999 | McDonough et al. | |
| 5,967,768 | A | 10/1999 | Saito et al. | |
| 5,971,751 | A | 10/1999 | Lee | |
| 6,022,212 | A | 2/2000 | Saito et al. | |
| 6,042,367 | A | 3/2000 | Saito et al. | |
| 6,065,958 | A | 5/2000 | Adams et al. | |
| 6,077,071 | A | 6/2000 | Yeh | |
| 6,086,360 | A | 7/2000 | McDonough et al. | |
| 6,093,017 | A | 7/2000 | Saito et al. | |
| 6,146,129 | A | 11/2000 | Li | |
| 6,168,420 | B1 | 1/2001 | Sung | |
| 6,213,759 | B1 | 4/2001 | Sung | |
| 6,224,368 | B1 | 5/2001 | Chung | |
| 6,267,582 | B1 | 7/2001 | Lin | |
| 6,488,492 | B2 | 12/2002 | Adams et al. | |
| 6,491,515 | B1 | 12/2002 | Tubby et al. | |
| 6,527,546 | B1 | 3/2003 | Adams et al. | |
| 6,682,341 | B2 * | 1/2004 | Pan et al. | 431/153 |
| 6,726,469 | B2 | 4/2004 | Adams et al. | |
| 6,837,704 | B1 | 1/2005 | Hsu | |
| 6,887,072 | B2 | 5/2005 | Judeng | |
| 6,908,302 | B2 | 6/2005 | Sgroi, Jr. et al. | |
| 2002/0055076 | A1 | 5/2002 | Adams et al. | |
| 2002/0055077 | A1 | 5/2002 | Adams et al. | |
| 2002/0106601 | A1 | 8/2002 | Adams et al. | |
| 2002/0150852 | A1 | 10/2002 | Zhang | |
| 2004/0081931 | A1 | 4/2004 | Sgroi et al. | |
| 2004/0166453 | A1 | 8/2004 | Adams et al. | |

* cited by examiner

MULTI-MODE LIGHTER

CROSS-REFERENCE TO RELATED APPLICATIONS

The present application is a continuation-in-part of U.S. patent application Ser. No. 11/145,306, filed Jun. 3, 2005 now U.S. Pat. No. 7,070,408, which is a divisional of U.S. patent application Ser. No. 10/389,975, filed Mar. 18, 2003, now U.S. Pat. No. 6,908,302, which is a continuation-in-part of U.S. patent application Ser. No. 10/085,045, filed Mar. 1, 2002, now U.S. Pat. No. 6,726,469, which is a continuation-in-part of both U.S. patent application Ser. No. 09/817,278, now U.S. Pat. No. 6,916,171, and U.S. patent application Ser. No. 09/819,021, now U.S. Pat. No. 6,488,492, both of which were filed on Mar. 27, 2001, and both of which are continuations-in-part of U.S. patent application Ser. No. 09/704,689, filed Nov. 3, 2000, now U.S. Pat. No. 6,491,515. The contents of these five applications are expressly incorporated herein by reference thereto.

TECHNICAL FIELD OF THE INVENTION

The present invention generally relates to lighters such as pocket lighters used to light cigarettes and cigars, or utility lighters used to ignite candles, barbecue grills, fireplaces and campfires, and more particularly to such lighters which resist inadvertent operation or undesirable operation by unintended users.

BACKGROUND OF THE INVENTION

Lighters used for igniting tobacco products, such as cigars, cigarettes, and pipes, have developed over a number of years. Typically, these lighters use either a rotary friction element or a piezoelectric element to generate a spark near a nozzle which emits fuel from a fuel container. Piezoelectric mechanisms have gained acceptance because they are simple to use. U.S. Pat. No. 5,262,697 ("the '697 patent") to Meury discloses one such piezoelectric mechanism, the disclosure of which is incorporated by reference herein in its entirety.

Lighters have also evolved from small cigarette or pocket lighters to several forms of extended or utility lighters. These utility lighters are more useful for purposes such as lighting candles, barbecue grills, fireplaces and campfires. Earlier attempts at such designs relied simply on extended actuating handles to house a typical pocket lighter at the end. U.S. Pat. Nos. 4,259,059 and 4,462,791 contain examples of this concept.

Many pocket and utility lighters have had some mechanism for resisting undesired operation of the lighter by young children. Often, these mechanisms are on/off switches which may shut off the fuel source or may prevent movement of an actuator, such as a push-button, on the lighter. On/off switches which a user positively moves between "on" and "off" positions can be problematic. For example, an adult user may forget to move the switch back to the "off" position after use and thereby render the feature ineffective. Other pocket and utility lighters include a spring-biased blocking latch which arrests or prevents movement of the actuator or push-button. U.S. Pat. No. 5,697,775 to Saito and U.S. Pat. No. 5,145,358 to Shike et al., disclose examples of such lighters.

There remains a need for lighters which resist inadvertent operation or undesirable operation by unintended users, but which provide each intended user with a consumer-friendly method of operating the lighters so that the lighters appeal to a variety of intended users.

SUMMARY OF THE INVENTION

The present invention is directed to a lighter with at least two modes of operation. In either mode of operation, the lighter preferably is operational with no blocking mechanism(s) which arrests or prevents movement of an actuating member.

The present invention, in one embodiment, relates to a lighter which generally comprises a housing which contains fuel, a housing having a supply of fuel, an igniting assembly for igniting released fuel, an actuating assembly that includes an actuating member pivotably connected to the housing for performing at least one step in igniting the fuel, and a latch member moveable by a user between a first latch member position and a second latch member position. A user applies a first actuating force to the actuating member to ignite the fuel when the latch member is positioned in the first latch member position, and a second actuating force to the actuating member to ignite the fuel when the latch member is positioned in the second latch member position. The first actuating force being greater than the second actuating force.

More specifically, in one embodiment, a plunger member, operatively associated with the latch member, in the high-actuation-force position directly drives a second biasing member so that the second biasing member together with a first biasing member, associated with the actuating assembly provides a first opposing force which opposes or resists actuation of the lighter. When the user moves or repositions the plunger member to the low-actuation-force position, the second biasing member does not oppose or resist actuation of the lighter while the first biasing member still opposes actuation of the lighter.

Preferably, the first opposing force provided by the first and second biasing members is greater, and optionally significantly greater, than the second opposing force.

In accordance with one embodiment, the actuating member may selectively dispense fuel, activate an ignition assembly or perform both functions. The lighter optionally may have an ignition assembly actuated by the actuating member. The ignition assembly may include a piezoelectric unit. The actuating member may be at least one activation mechanism. In the high-actuation-force position, the first and second biasing members may resist movement of the activation mechanism to an actuation position by increasing the force necessary to actuate the activation mechanism.

The latch member can be coupled to the housing such that it moves in a linear direction. Movement of the latch member may move the plunger member between the high-actuation-force position and the low-actuation-force position.

One preferred aspect of the multi-mode lighter according to at least one embodiment is that after multiple actuations of the lighter, the first and second activation mechanism forces required to operate the lighter in either mode, and more preferably the first activation mechanism force, remain substantially constant. Thus, the first and second opposing forces exerted by the first and second biasing members preferably do not substantially decrease with use of the lighter.

According to yet another embodiment, the lighter comprises a housing having a supply of fuel, an actuating assembly for selectively releasing the fuel, where the actuating assembly includes an actuating member pivotably connected to the housing, an ignition assembly for igniting the dispensed fuel, and a latch member movable in a linear direction to permit movement between a first latch position and a second latch position. The lighter further includes a plunger member operatively associated with the latch member, a first biasing member operatively associated with the actuating assembly, and a second biasing member operatively associated with the plunger member. In a first latch member position where the plunger member is in an initial state, the first and second biasing members resist movement of the actuating member to ignite the released fuel. In a second latch member position, the plunger having been repositioned by the latch member, the second biasing member does not resist movement of the actuating member, while the first biasing member continues to resist movement of the actuating member. The actuating member is movable to ignite the released fuel when the plunger member is in the first member position and when the plunger is in the second member position.

According to a preferred aspect of the multi-mode lighter, the first or high-actuation-force mode preferably relies more on the user's physical characteristics, and more specifically strength characteristics, while the second or low-actuation-force mode preferably relies more on the user's cognitive abilities and dexterity. In yet another preferred, but optional, aspect of this lighter, the user may actuate the lighter in the high-actuation-force mode with a single finger. Moreover, according to another preferred, but optional, aspect of this lighter, the user may actuate the lighter in the low-actuation-force mode with two fingers. One further preferred, but optional, feature of the lighter is that actuation of the lighter in the high-actuation-force mode may occur by a different actuation sequence or movement than the actuation sequence or movements which may occur in the low-actuation-force mode.

BRIEF DESCRIPTION OF THE DRAWINGS

The multi-mode lighter and the method of use are explained in even greater detail in the following exemplary drawings. The multi-mode lighter and its method of operation may be better understood by reference to the following drawings, wherein like references numerals represent like elements. The drawings are merely exemplary to illustrate the structure, operation and method of use of the multi-mode lighter and certain features that may be used singularly or in combination with other features and the invention should not be limited to the embodiments shown.

DETAILED DESCRIPTION OF THE PREFERRED EMBODIMENTS

Figure 1:
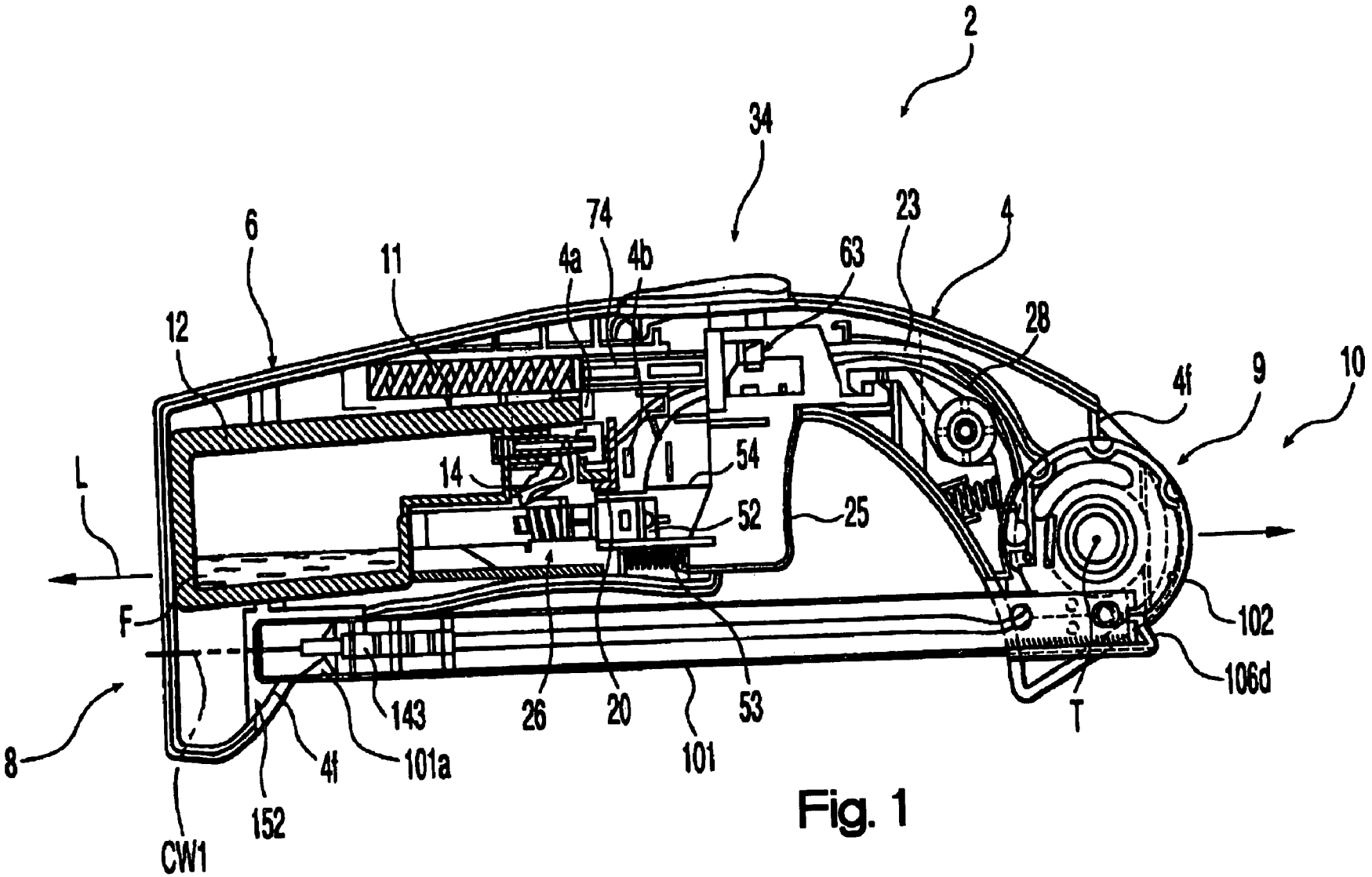
FIG. 1 is a cut-away, side view of a utility lighter of one embodiment with various components removed for clarity and better illustrating various inner details, wherein the lighter is in an initial state, a wand assembly is in a closed position, and an activation mechanism and latch member are in initial states, and a plunger member is in a high-actuation-force position.

Turning to FIG. 1, an embodiment of a utility lighter 2 constructed in accordance with the present invention is shown with the understanding that those of ordinary skill in the art will recognize many modifications and substitutions which may be made to various elements. While the invention will be described with reference to a utility lighter, one of ordinary skill in the art could readily adapt the teaching to conventional pocket lighters and the like.

Lighter 2 generally includes a housing 4 which may be formed primarily of molded-rigid-polymer or plastic materials such as acrylonitrile butadiene styrene terpolymer or the like. The housing 4 may also be formed of two-parts that are joined together by techniques known by those of ordinary skill in the art, such as ultrasonic welding.

Housing 4 includes various support members, such as support member 4*a* discussed below. Further support members are provided in the lighter 2 for various purposes, such as supporting components or directing the travel path of components. The housing 4 further includes a handle 6, which forms a first end 8 and a second end 9 of the housing. A wand assembly 10, as discussed in detail below, is pivotally connected to the second end 9 of the housing.

Figure 1A:
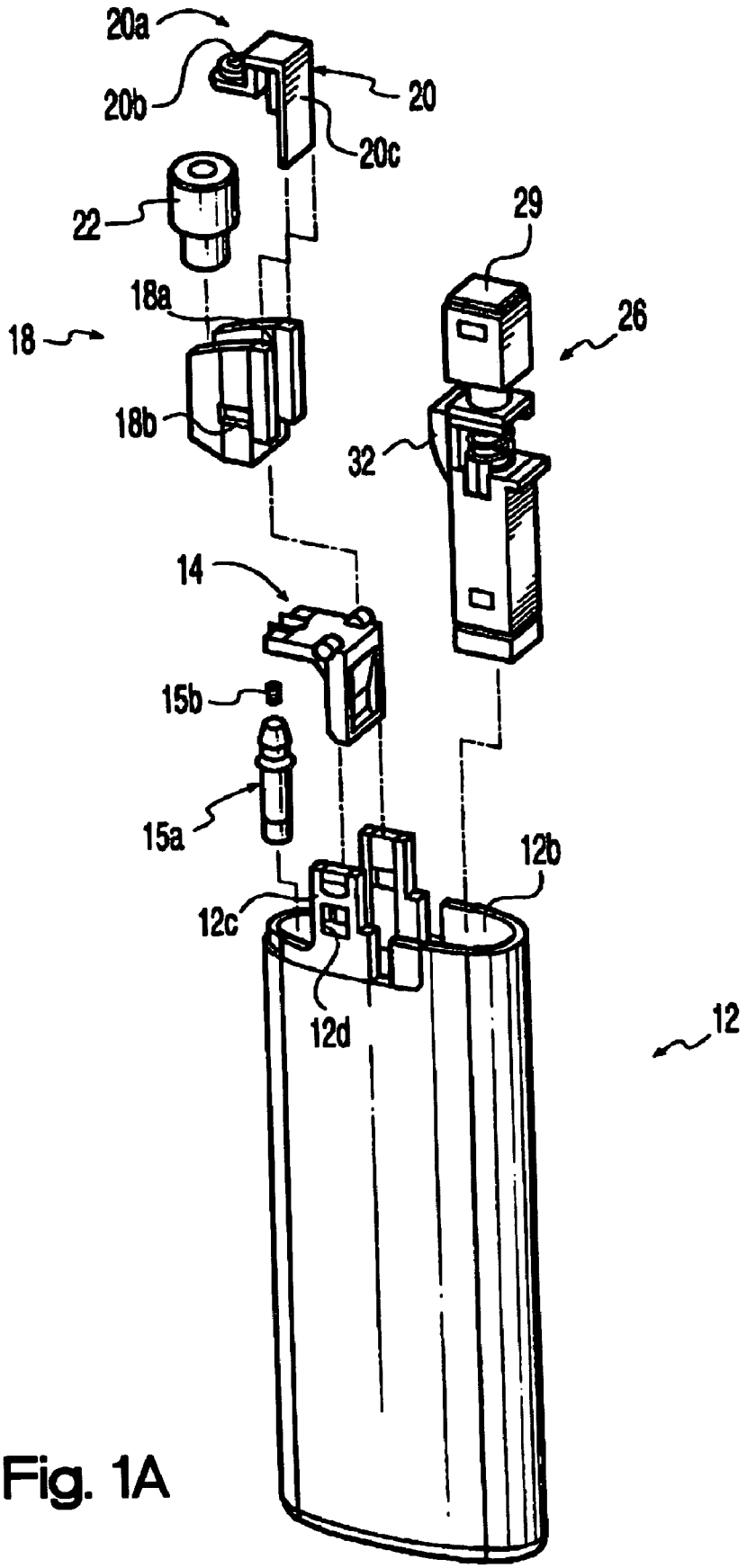
FIG. 1A is an enlarged, exploded, perspective view of several components of a fuel supply unit for use in the lighter of FIG. 1.
Figure 1B:
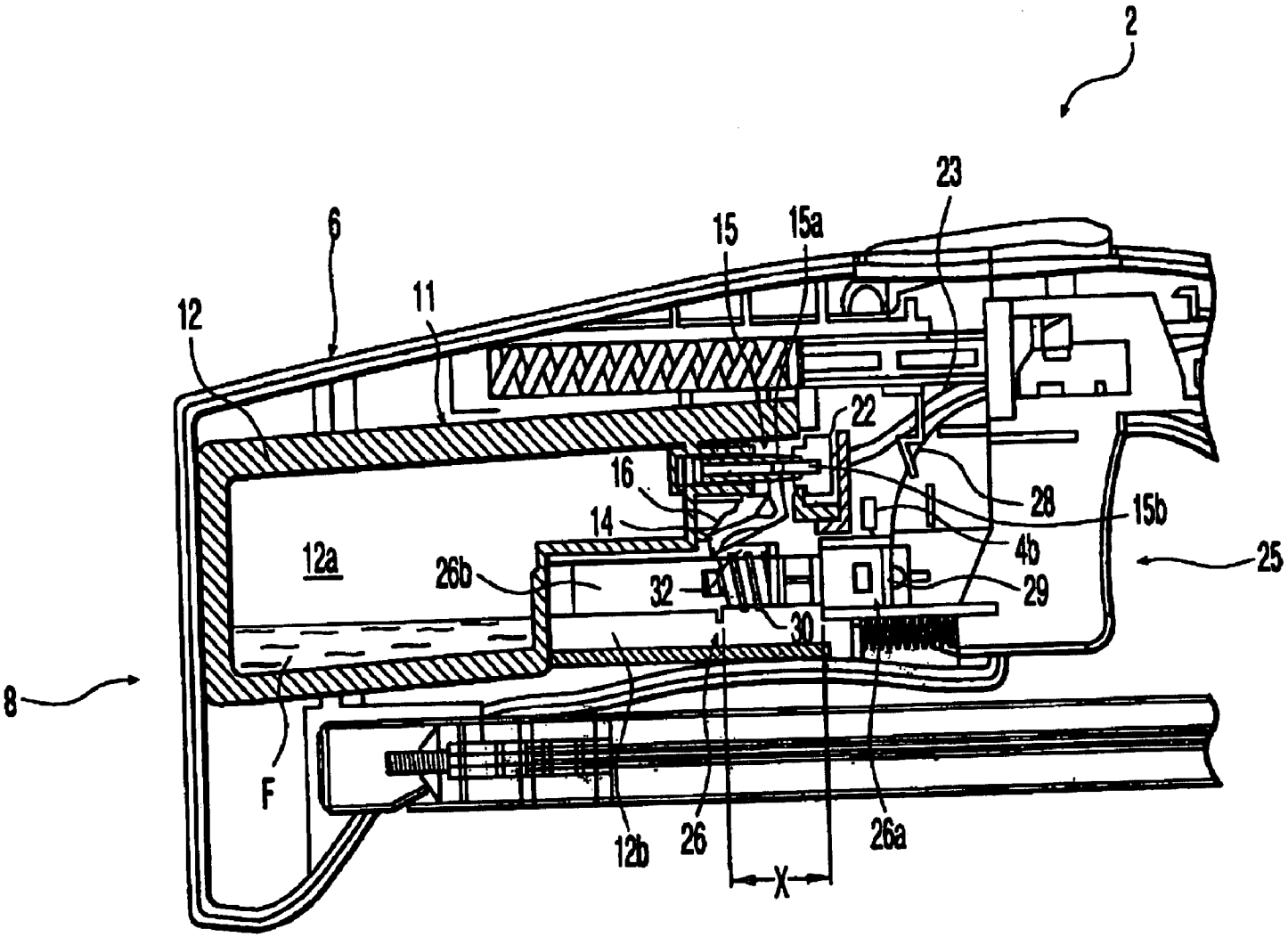
FIG. 1B is an enlarged, cut-away, side view of a rear portion of the utility lighter of FIG. 1.

Referring to FIGS. 1, 1A, and 1B, handle 6 preferably contains a fuel supply unit 11 that includes a fuel supply container or main body 12, a valve actuator 14, a jet and valve assembly 15, a spring 16, a guide 18, and a retainer 20. The container 12 supports the other components of the fuel supply unit 11 and defines a fuel compartment 12*a* and a chamber 12*b*, and further includes a pair of spaced support members 12*c* extending upward from the top edge thereof. The support members 12*c* define openings 12*d*. The fuel compartment 12*a* contains fuel F, which may be compressed hydrocarbon gas, such as butane or a propane and butane mixture, or the like.

Referring to FIGS. 1A and 1B, the valve actuator 14 is rotatably supported on the compartment 12 below the support members 12*c*. The valve actuator 14 is connected to a jet and valve assembly 15 that includes a jet or valve stem 15*a* and an electrode 15*b*. The electrode 15*b* is optional. The jet and valve assembly 15 is a normally open valve design, and closed by the pressure of a spring member 16 on valve actuator 14. Alternatively, a jet and valve assembly with a normally closed valve design can also be used.

A suitable fuel supply unit 11 is disclosed in U.S. Pat. No. 5,934,895 ("the '895 patent"), the disclosure of which is incorporated herein by reference in its entirety. An alternative arrangement for the fuel supply unit 11 that can be used is disclosed in U.S. Pat. No. 5,520,197 ("the '197 patent") or U.S. Pat. No. 5,435,719 ("the '719 patent"), the disclosures of which are incorporated by reference in their entirety. The fuel supply units disclosed in the above patents can be used with all of the disclosed components or with various components removed, such as windshields, latch springs, latches, and the like, as desired by one of ordinary skill in the art. Alternative arrangements of the fuel supply unit can be used.

Referring to FIG. 1A, guide 18 has walls to define a slot 18*a* and projections 18*b*. When the lighter is assembled, the guide 18 is disposed between the support members 12*c*, and the support members 12*c* flex outward to accommodate the guide 18. Once the projections 18*b* are aligned with the openings 12*d*, the support members 12*c* may return to their vertical, initial positions. The interaction between the projections 18*b* and the openings 12*d* allow the guide 18 to be retained within the main body 12.

Referring to FIGS. 1A and 1B, retainer 20 has a front portion 20*a* that defines a bore 20*b* and a L-shaped rearward portion 20*c*. A fuel connector 22 is disposed on the top of jet 15*a* and receives a fuel conduit 23 therein. The connector 22, however, is optional and if not used the conduit 23 can be disposed on the jet 15*a* directly.

The retainer 20 properly positions fuel conduit 23 with respect to the jet and valve assembly 15 by receiving conduit 23 through the bore 20*b* so that the conduit 23 is within the connector 22. Details of the conduit 23 will be discussed below. The rearward portion 20*c* of the retainer 20 is disposed within the slot 18*a* of the guide 18. The retainer 20 and guide 18 may be configured so that these components snap-fit together so that the conduit 23 is properly positioned with respect to the jet and valve assembly 15. The guide 18 and retainer 20 are optional and the housing 4 or other components of the lighter can be used to support and position the connector 22 and the conduit 23. In addition, the guide and retainer 20 may be configured differently so long as they function to locate connector 22 and conduit 23 to jet 15*a*.

The container 12, guide 18, retainer 20, and connector 22 may be made with plastic material. However, the valve actuator 14, valve stem 15*a*, and electrode 15*b* are preferably formed of electrically conductive materials. The fuel supply unit 11 can be a preassembled unit that may include the fuel supply container 12, the jet and valve assembly 15, and the biased valve actuator 14. When the fuel supply unit 11 is disposed within the lighter, the housing support member 4*a* aids in locating and maintaining the position of the unit 11, as shown in FIG. 1. The housing support member 4*b* aids in positioning the retainer 20.

Referring again to FIG. 1, lighter 2 also includes an actuating member 25 which facilitates movement of the valve actuator 14 to selectively release fuel F. In this embodiment, the actuating member also selectively activates an ignition assembly 26 for igniting the fuel. Alternatively, the actuating member may perform either the fuel release or ignition function, and another mechanism or assembly may perform the other function. Actuating member 25 in the illustrated embodiment comprises an activation mechanism. In an alternative embodiment, as discussed below, the actuating member can be part of an actuating assembly.

Referring to FIG. 1B, although not necessary for all aspects of this invention, an electric ignition assembly such as a piezoelectric mechanism is the preferred ignition assembly 26. The ignition assembly may alternatively include other electronic ignition components, such as shown in U.S. Pat. No. 3,758,820 and U.S. Pat. No. 5,496,169, a spark wheel and flint assembly or other well-known mechanisms in the art for generating a spark or igniting fuel. The ignition assembly may alternatively include a battery having, for example, a coil connected across its terminals. The piezoelectric mechanism may be the type disclosed in the '697 patent. Piezoelectric mechanism 26 has been illustrated in FIG. 1B schematically and particularly described in the '697 patent.

The piezoelectric unit 26 includes an upper portion 26*a* and a lower portion 26*b* that slide with respect to each other along a common axis. A coil spring or return spring 30 is positioned between the upper and lower portions 26*a*, 26*b* of piezoelectric unit. The return spring 30 serves to resist the compression of piezoelectric unit, and when positioned in the actuating member 25 resists the depression of actuating member 25. The lower portion 26*b* of piezoelectric unit is received in cooperating chamber 12*b* in fuel supply unit 11.

The piezoelectric unit 26 further includes an electrical contact or cam member 32 fixedly connected to the upper portion 26*a*. In the initial position, the portions 26*a*, 26*b* are separated by a gap X. The cam member 32 is formed of a conductive material. The upper portion 26*a* is coupled to actuating member 25. Spark conductor or wire 28 is partially insulated and may be electrically connected with the electrical contact 29 of the piezoelectric unit in any known manner.

Figure 2:
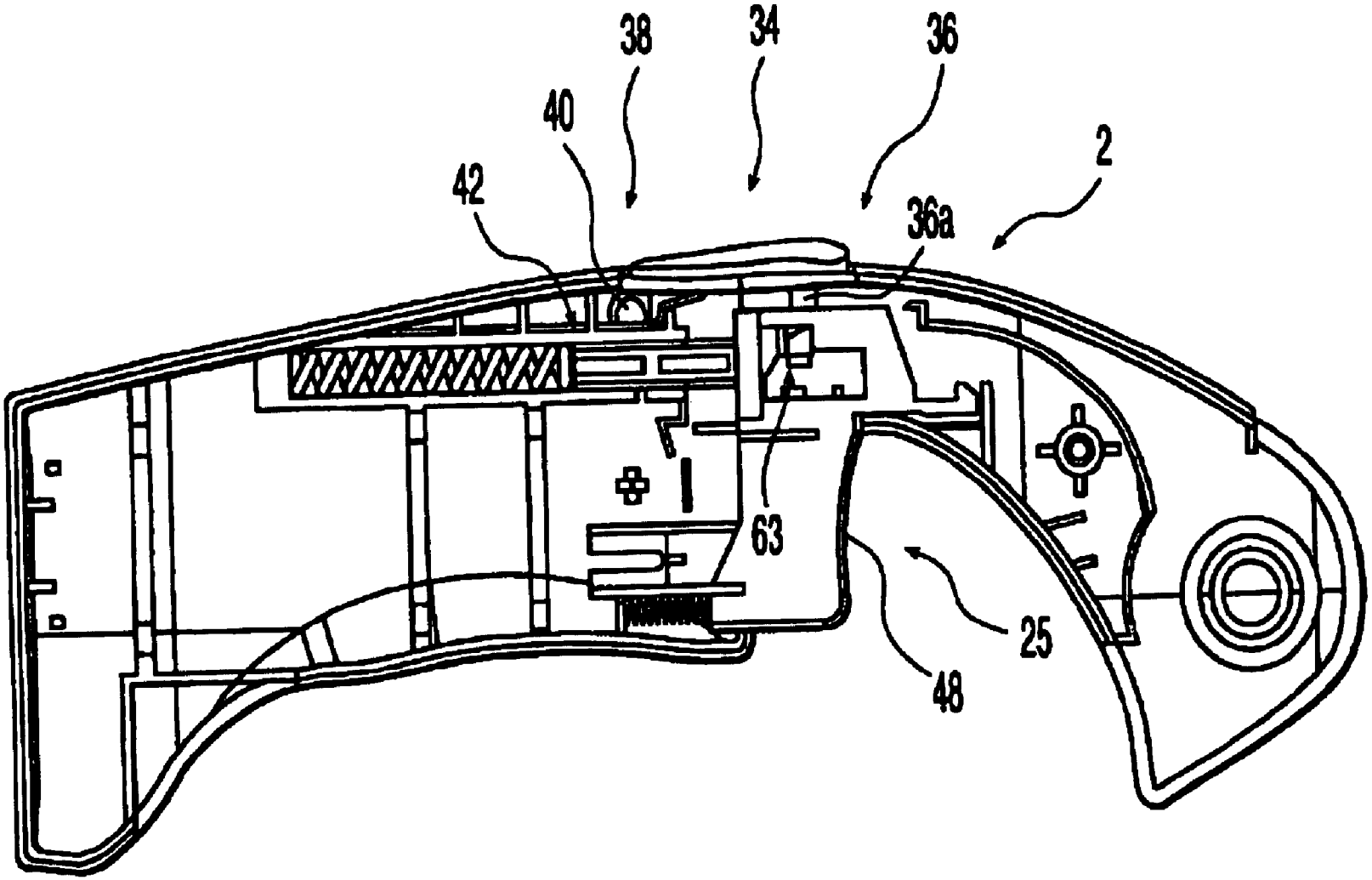
FIG. 2 is a partial, side view of the lighter of FIG. 1 with various components removed for clarity and better illustrating various inner details such as a latch member, a plunger member and a biasing member, wherein the activation mechanism and latch member are in initial states, and the plunger member is in a high-actuation-force position.
Figure 3:
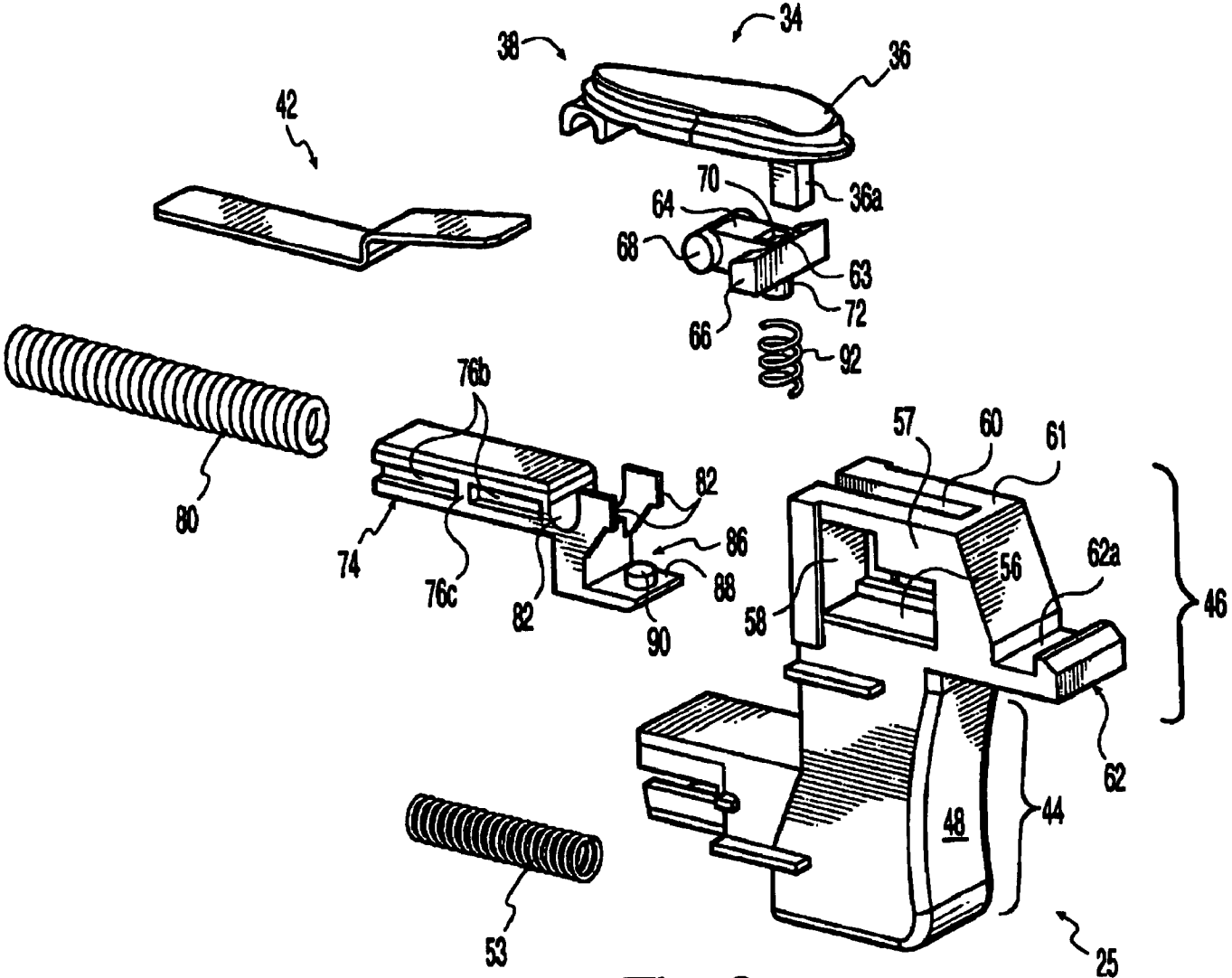
FIG. 3 is an enlarged, exploded, perspective view of various components of the lighter of FIG. 1 without a housing.
Figure 4:
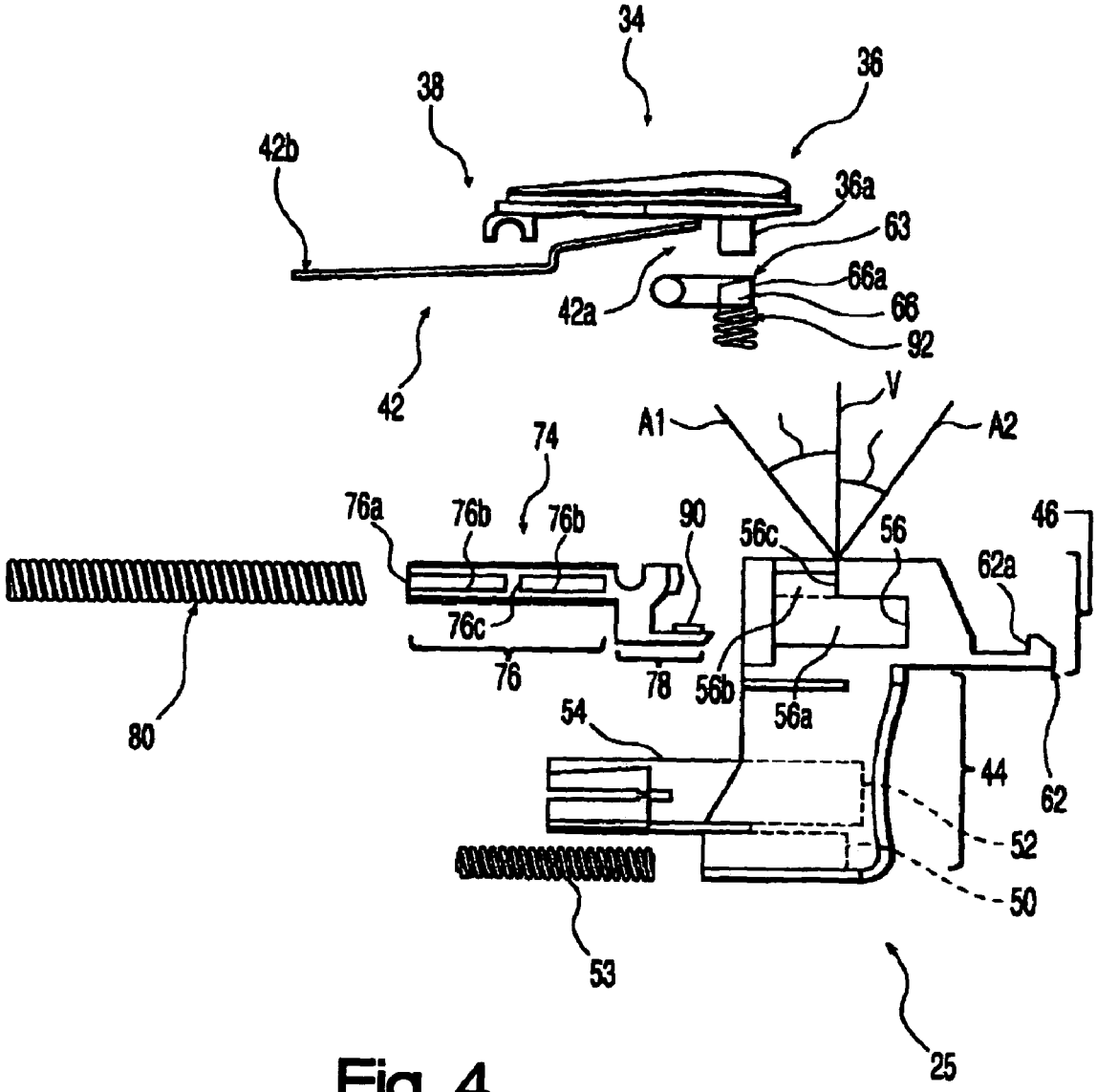
FIG. 4 is an enlarged, side view of the components of FIG. 3.

As shown in FIG. 1, latch member 34 is on the top side of the handle 6 and the actuating member 25 is opposite the latch member 34 near the bottom side of the handle 6. Referring to FIGS. 2-4, the latch member 34 generally includes an unsupported, movable, front end 36 which includes a downwardly extending boss 36*a* and a rear end 38 pivotally fixed to a hinge 40 of the housing 4. One of ordinary skill in the art can readily appreciate that latch member 34 also may be coupled to the housing in another manner such as in a cantilevered fashion, slidably or rotatably. When the latch member 34 is slidable a cam may be used therewith.

Referring to FIGS. 3 and 4, a leaf spring 42 includes a front end 42*a* and a rear end 42*b*. The leaf spring 42 is bent, as best seen in FIG. 4, so that the front end 42*a* is spaced above the rear end 42*b*. The shape of the leaf spring can be modified such as being planar depending on the arrangement of the components in the lighter and the necessary space considerations. Alternatively, the leaf spring may be disposed in front of latch member 34. In addition, the leaf spring may be replaced with a coil spring, a cantilever spring or any other biasing member suitable for biasing the latch member 34.

Figure 5:
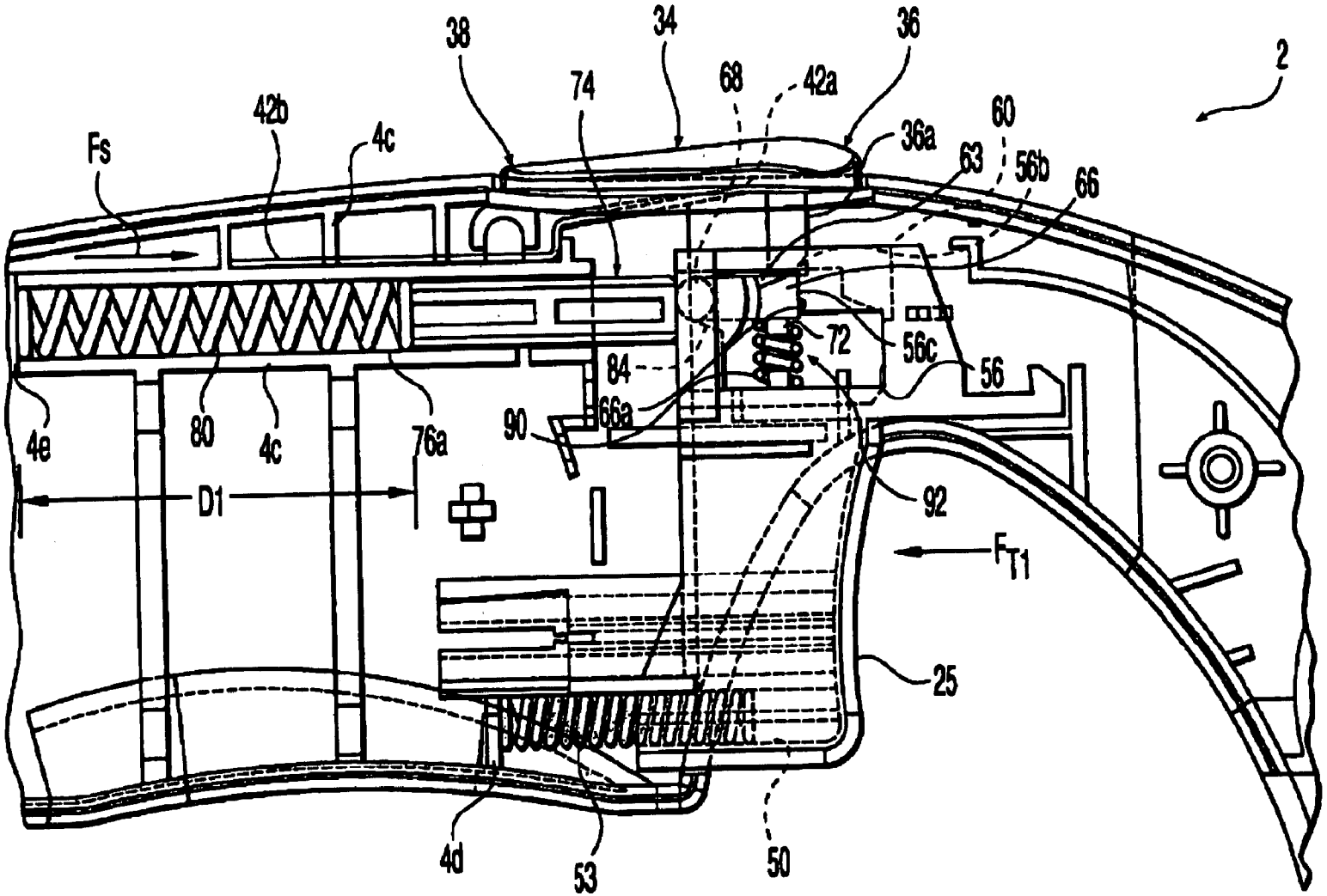
FIG. 5 is an enlarged, partial, side view of the lighter of FIG. 1, where the plunger member is in the high-actuation-force position and the activation mechanism is in an initial position.

Referring to FIG. 5, the rear end 42*b* of the leaf spring 42 is disposed within the housing 4 between support members 4*c* such that end 42*b* is coupled to the housing 4 such that spring 42 operates substantially like a cantilevered member. Due to the configuration, dimensions, and material of the spring 42, the front end 42*a* is free to move and is biased upward to return the latch member front end 36 to its initial position, as shown in FIG. 5. Thus, unsupported front end 36 of latch member 34 may be moved downwardly along with the front end 42*a* of spring 42.

Latch member 34 is preferably formed of plastic, while leaf spring 42 is preferably manufactured from a metal having resilient properties, such as spring steel, stainless steel, or from other types of materials. It should be noted that while leaf spring 42 is shown mounted to housing 4 it may alternatively be coupled to other components of the lighter.

Referring to FIG. 1, further details of the actuating member or activation mechanism 25, will now be discussed. Activation mechanism 25 is preferably slidably coupled to housing 4. The activation mechanism 25 and housing 4 may be configured and dimensioned so that movement of the activation mechanism forward or rearward is limited. One of ordinary skill in the art can appreciate that the activation mechanism can alternatively be coupled or connected to the housing in another manner, such as in a pivotal, rotatable or cantilevered fashion. For example, the activation mechanism can be a linkage system or formed of two pieces, where one piece is slidably coupled to the housing and the other piece pivots.

Turning again to FIG. 3, the activation mechanism 25 includes a lower portion 44 and an upper portion 46. Referring to FIGS. 3-4, the lower portion 44 includes a forward finger actuation surface 48, a first chamber 50 (shown in phantom), and a second chamber 52 (shown in phantom). When the activation mechanism 25 is disposed within the housing 4, the finger actuation surface 48 extends from the housing so that it is accessible by a user's finger (not shown).

In this embodiment, the activation mechanism 25 lower and upper portions are formed as a single piece. Alternatively, the upper and lower portions can be two separate pieces coupled together or the activation mechanism can be part of a multiple piece unit.

Referring to FIGS. 4 and 5, the first and second chambers 50 and 52 of the activation mechanism 25 are horizontally disposed. The first chamber 50 is below the second chamber 52, and the first chamber 50 is configured to receive an activation mechanism return spring 53. The spring 53 is disposed between the activation mechanism 25 and a first spring stop portion or support member 4*d* of the housing 4. Referring to FIG. 4, the activation mechanism 25 further includes an extension 54 extending rearwardly from the lower portion 44. The second chamber 52 extends into the extension 54. The second chamber 52 is configured to receive the ignition assembly 26 (as shown in FIG. 1).

Referring to FIGS. 3 and 4, the upper portion 46 of the activation mechanism 25 includes two L-shaped guides. In this embodiment the guides are side cutouts, represented by cutout 56, in side wall 57. The cutout 56 includes a first portion 56*a* and a second portion 56*b* in communication with the first portion 56*a*. The second portion 56*b* includes a wall 56*c* substantially parallel to vertical axis V. Vertical axis V is perpendicular to longitudinal axis L and transverse axis T (shown in FIG. 1). In this embodiment, the guides are cutouts but in another embodiment the activation mechanism can have solid side walls and the guides can be formed on the inner surface of the side walls.

Referring to FIG. 3, the upper portion 46 of the activation mechanism also includes a rear cutout 58 and slot 60 in an upper wall 61 of the activation mechanism. The upper portion 46 further includes a forwardly extending engaging portion 62 with an engaging surface 62*a*. The function of the engaging portion 62 will be discussed in detail below.

Referring to FIGS. 1 and 3, in this embodiment the upper portion 46 of the activation mechanism 25 and the guides 56 form a portion of a dual-mode assembly. The dual-mode assembly also includes a plunger member 63 and a piston member 74. In this embodiment, the lower and upper portions 44 and 46 of the activation mechanism are formed as a single piece. In another embodiment, the lower and upper portions 44 and 46 can be formed as separate pieces and operatively connected together.

The plunger member 63 when installed in the lighter is disposed below the latch member 34. The plunger member 63 is substantially T-shaped with a longitudinally extending body portion 64 and transversely extending head portions 66. As best seen in FIG. 4, the head portions 66 have a planar, front surface 66*a*. Surface 66*a* is generally parallel to vertical axis V, when plunger member 63 is installed within activation mechanism 25.

Referring again to FIG. 3, the body portion 64 includes two transversely extending pins 68 at the rear end, a recess 70 on the upper surface, and a vertically extending projection 72 that extends from the bottom surface of the body portion 64. Recess 70 is optional.

Referring to FIGS. 3 and 4, in alternative embodiments, the wall 56*c* of the activation mechanism 25 and the wall 66*a* of the plunger member 63 can be configured differently. For example, walls may alternatively be angled with respect to vertical axis V. For example, walls 66*a* and 56*c* may be angled to be substantially parallel to line A1, which is angularly offset from vertical axis V by angle β. Walls 66*a*, 56*c* may alternatively be angled to be substantially parallel to line A2, which is angularly offset from vertical axis V by angle θ. Alternatively, wall 56*c* can be configured to include a V-shaped notch and the wall 66*a* can include a V-shaped projection to be received in notch of wall 56*c* or vice versa.

Referring to FIGS. 4 and 5, the piston member 74 includes a rear portion 76 and a front portion 78. The rear portion 76 includes a vertical rear wall 76*a* for contacting a high-force spring or biasing member 80. The spring 80 is disposed between the wall 76*a* and the second spring stop portion or support member 4*e* of the housing 4. Turning again to FIG. 4, the rear portion 76 further includes horizontal cutouts 76*b* that define a stop member 76*c*. The cutouts 76*b* and stop member 76*c* allow the piston member 74 to be slidably mounted to rails (not shown) in the housing and to allow the piston member 74 to slide longitudinally a predetermined distance so that the plunger member 63 can function as discussed below.

Referring to FIGS. 3 and 4, the front portion 78 of the piston member 74 includes two spaced apart arms 82. The arms 82 and front portion 78 define a cutout 84 that receives the pins 68 of the plunger member 63. The cutout 84 and pins 68 of the plunger member 63 are configured and dimensioned to allow the plunger member 63 to pivot with respect to the piston member 74, as discussed in detail below. In this embodiment, the plunger member 63 is pivotally connected to the piston member 74, however in another embodiment the plunger member 63 can be fixedly connected to the piston member 74 but be resiliently deformable.

The front portion 78 of piston member 74 further includes a downwardly extending support portion 86 that includes a horizontal platform 88 with an upwardly extending pin 90. Referring to FIGS. 3 and 5, when the piston member 74 is assembled within the lighter, the platform 88 is disposed through the rear cutout 58 of activation mechanism 25, and the pin 90 may be aligned with the pin 72 of the plunger member 63 so that the pins 72, 90 retain a plunger return spring 92 there between. The plunger member 63 contacts the bottom surface of upper wall 61 (as shown in FIG. 3) due to the return spring 92 that biases the plunger member upward toward an initial position.

Figure 3A:
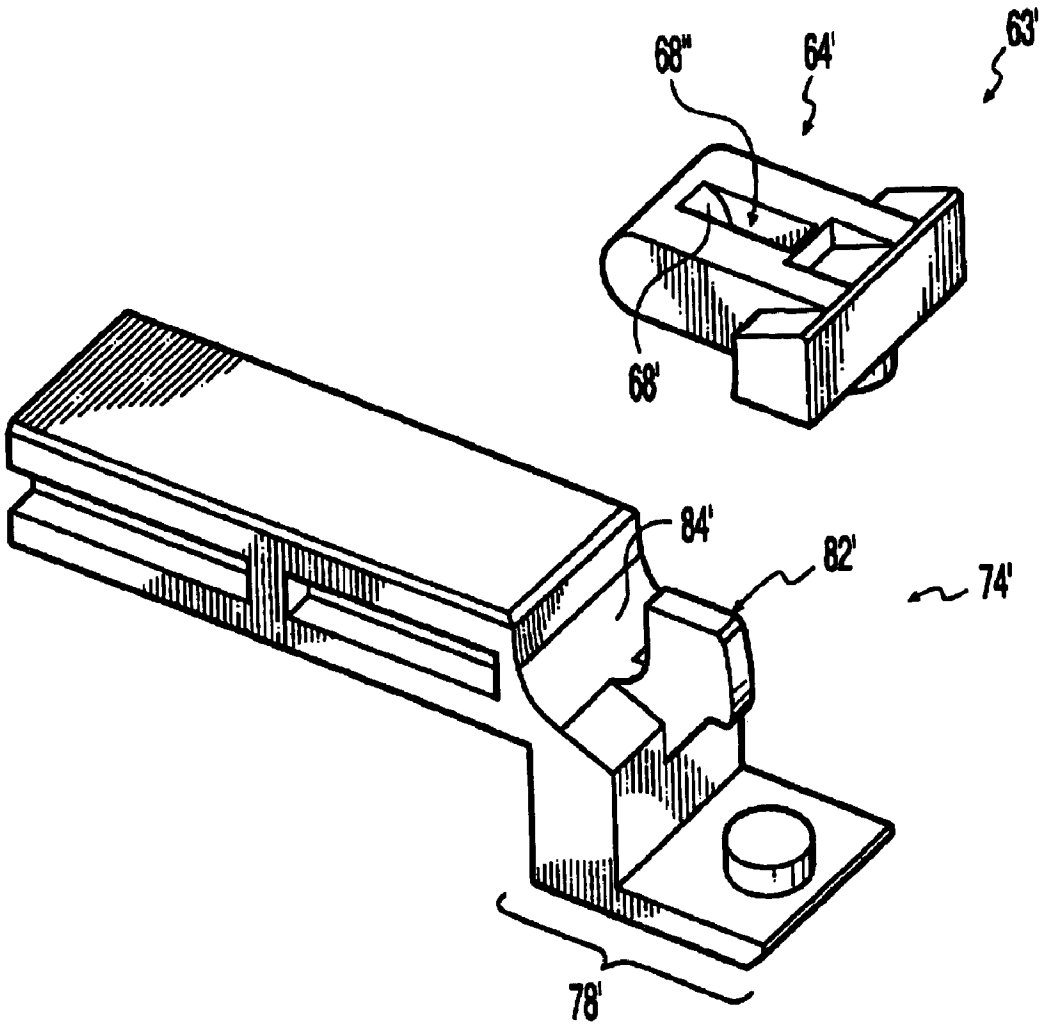
FIG. 3A is an enlarged, exploded, perspective view of another embodiment of the plunger member and a piston member for use with the lighter of FIG. 1.

Referring to FIG. 3A, a preferred embodiment of a plunger member 63' and a piston member 74' are shown for use with the lighter 2 of FIG. 1. The plunger member 63' is similar to plunger member 63 except the body portion 64' includes a single central pin portion 68' and a slot 68". The piston member 74' is similar to piston member 74 except the front portion 78' of the piston member 74' includes a single arm 82' for defining a cutout 84' for pivotally supporting the pin 68' of the plunger member 63'. When the plunger member 63' pivots downward the slot 68" receives the arm 82'.

Figure 9:
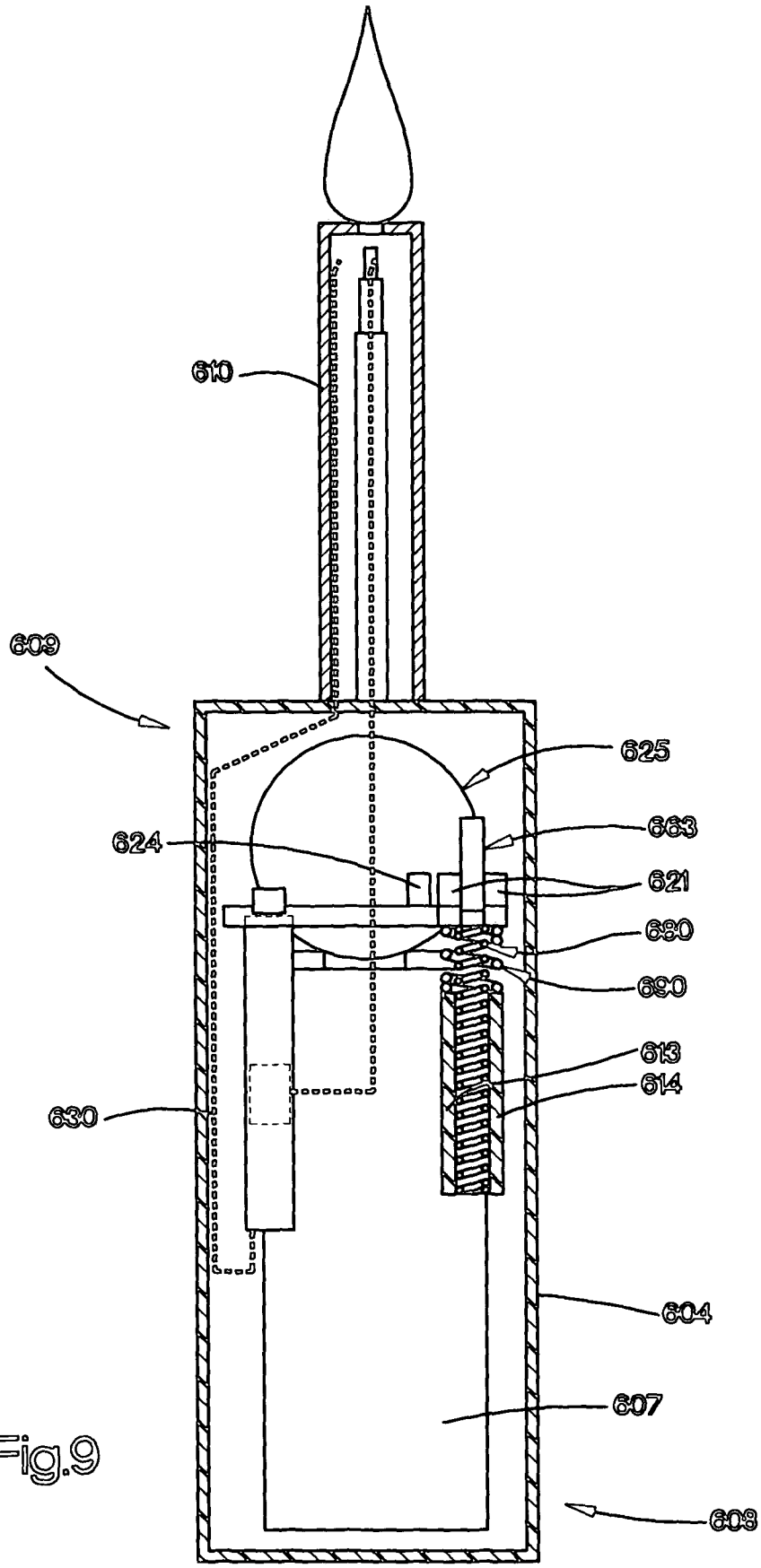
FIG. 9 is an exploded, partial, perspective view of the lighter of FIG. 1 showing the housing and the wand assembly separated.

The lighter 2 may include a wand assembly 10 that is at least 2 inches in length. The wand assembly 10 may be movably coupled to housing 4 and may be pivoted between a first position or closed position, shown in FIG. 1, and a second or open or fully-extended position (not shown). In the closed position, the wand assembly 10 is folded closely to housing 4 for convenient transportation and storage of lighter 2. In the fully-extended position, the wand assembly 10 extends outward and away from housing 4, the extended wand or wand assembly may also be fixed with respect to the lighter housing as shown in FIG. 9. The wand assembly in FIG. 9 may be formed separate from the lighter housing and coupled thereto.

The wand assembly 10 includes wand 101 fixedly connected to a base member 102. The wand 101 is a cylindrical tube of metal that receives the conduit 23 (as shown in FIG. 1) and wire 28. The conduit 23 may be used with lighter 2 to provide a passage for supplying fuel from the fuel supply unit 11 to nozzle 143. Referring to FIG. 1, conduit 23 and wire 28 run from the inside of housing 4, through at least a portion of wand assembly 10. The conduit 23 extends to the nozzle 143. The length of conduit 23 and wire 28 also allow the wand 101 to pivot.

The wand 101 also includes a tab 101*a* formed integrally therewith near the free end of the wand. Alternatively, a separate tab may be associated with wand.

Referring back to FIG. 1, the lighter housing 4 further includes a vertical wall 4*f* at the front end 9. The base member 102 further includes a projection 106*d* extending generally radially therefrom. Furthermore, when wand assembly 10 is in the fully-extended position, a slight clearance may exist between vertical wall 4*f* and projection 106*d* of base member 102. The wand assembly has a central axis CW1.

The lighter 2 may be operated in two different modes. Referring to FIG. 5, each mode is designed to resist undesired operation by unintended users in different ways. The first-operative mode or high-actuation-force mode (i.e., the high-force mode) and the second mode of operation or low-actuation-force mode (i.e., the low-force mode) are configured so that one mode or the other may be used. The high-force mode of lighter 2 provides resistance to undesirable operation of the lighter by unintended users based primarily on the physical differences, and, more particularly, the strength characteristics of unintended users versus some intended users. In this mode, a user applies a high-actuation or high-operative force to the activation mechanism 25 in order to operate the lighter. Optionally, the force which is necessary to operate the lighter 2 in this mode may be greater than unintended users can apply, but within the range which some intended users may apply.

The low-force mode of lighter 2 provides resistance to undesirable operation of the lighter by unintended users based more on the cognitive abilities of intended users than the high-force mode. More specifically, the second mode provides resistance due to a combination of cognitive abilities and physical differences, more particularly the size characteristics and dexterity between intended users and unintended users.

The low-force mode may rely on the user operating two components of the lighter to change the force, from the high-actuation force to the low-actuation force, which is required to be applied to the activation mechanism to operate the lighter. The low-force mode may rely on a user repositioning a plunger member 63 from a high-actuation-force position to a low-actuation-force position. The user may move the plunger member 63 by depressing a latch member 34. After moving the plunger member, the user may operate the lighter by applying less force to the activation mechanism. The low-force mode may rely on a combination of the physical and cognitive differences between intended and unintended users such as by modifying the shape, size or position of the latch member in relation to the activation mechanism, or alternatively, or in addition to, modifying the force and distance required to activate the latch member and the activation mechanism. Requiring the activation mechanism and latch member to be operated in a particular sequence also may be used to achieve the desired level of resistance to unintended operation.

Referring to FIG. 5, one embodiment of a lighter 2 having a high-force mode and a low-force mode will be described. The lighter of FIGS. 3 and 5 has a movable plunger member 63 operatively associated with latch member 34.

In an initial or rest position in the high-force mode, as shown in FIG. 5, the plunger member 63, and more particularly portions 66 are disposed within portion 56*b* of cutout 56 defined in activation mechanism 25. The wall 66*a* of plunger member 63 contacts vertical wall 56*c* of slot 56 and is thus in a high-actuation-force position. When a user attempts to actuate activation mechanism 25, vertical wall 66*c* applies a force to vertical wall 66*a* which applies a force to piston member 74, which thru wall 76*a* moves to compress spring 80. Spring 80 applies a spring force $F_S$ which opposes movement of the activation mechanism 25. In the initial position, the spring 80 is uncompressed and has a length has a length of D1.

In this embodiment, the length D1 is substantially equal to the space between support 4*d* and piston member 74 end wall 76*a*. In another embodiment, the length D1 can be greater than this space so that the spring 80 is compressed and preloaded when installed or the length D1 can be less than this space.

To actuate the lighter in this high-force mode, i.e., when the portions 66 are disposed in slot portion 56*b*, a user applies at least a first activation mechanism force $F_{T1}$ to the activation mechanism 25 which is substantially equal to or greater than the sum of a spring force $F_S$, and all additional opposing forces $F_{OP}$. (not shown). The spring force $F_S$ may comprise the force necessary to compress the spring 80. The opposing forces $F_{OP}$ may comprise the forces applied by the various other elements and assemblies which are moved and activated in order to operate the lighter, such as the spring force from the return spring 30 (see FIG. 1B) in piezoelectric unit 26, the force to compress spring 53, and the frictional forces caused by the movements of the actuating member, and any other forces due to springs and biasing members which are part of or added to the actuating member or actuating assembly, fuel container, or which are overcome to actuate the lighter. The particular forces $F_{OP}$ opposing operation of the lighter would depend upon the configuration and design of the lighter and thus will change from one lighter design to a different lighter design. In this mode, if the force applied to the activation mechanism is less than a first activation mechanism force $F_{T1}$, ignition of the lighter does not occur.

Figure 6:
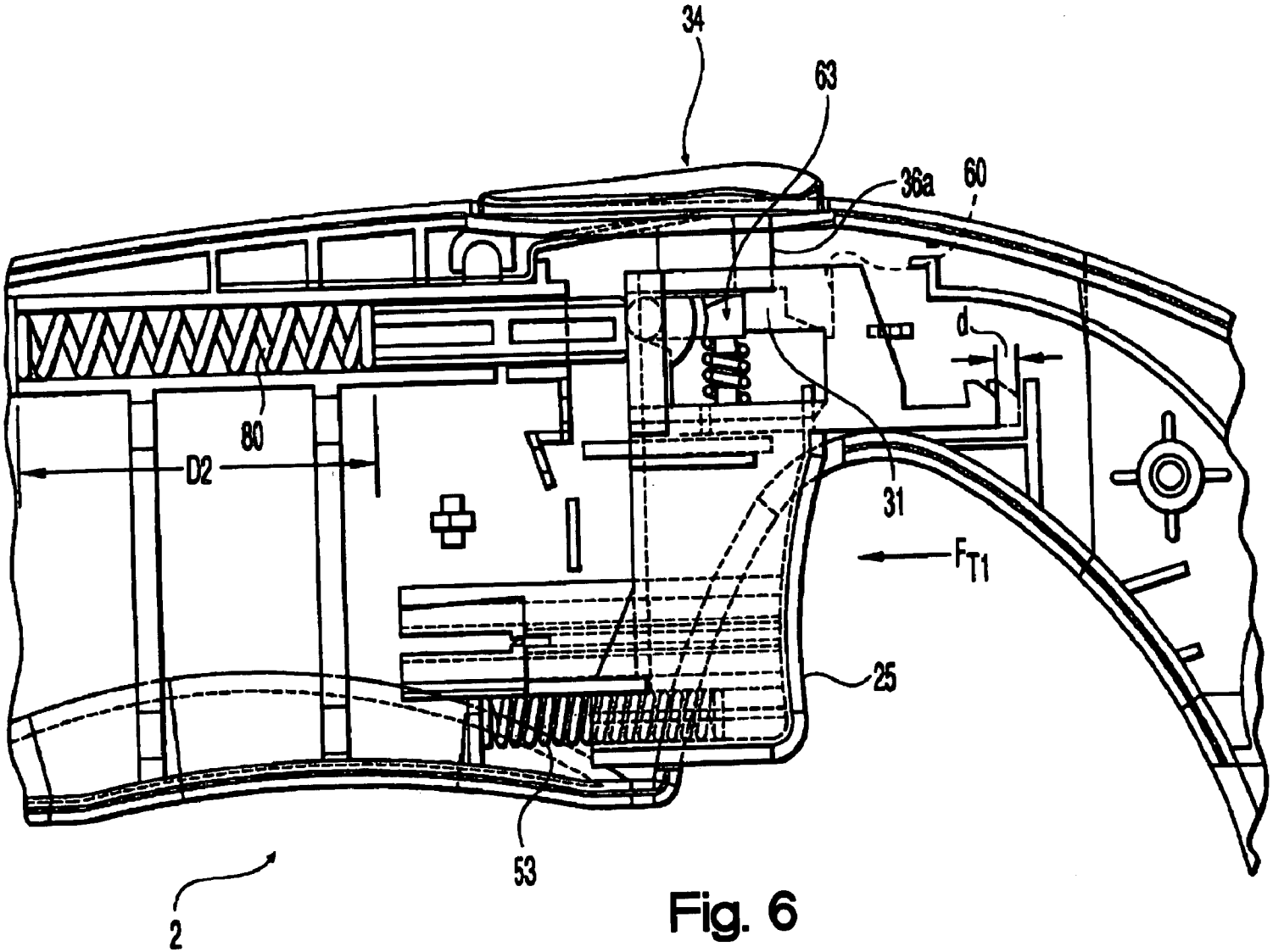
FIG. 6 is an enlarged, partial, side view of the lighter of FIG. 1, where the plunger member is in the high-actuation-force position and the activation mechanism is in a depressed position.

As shown in FIG. 6, when a user applies a force to the activation mechanism 25 at least substantially equal to or greater than the first activation mechanism force $F_{T1}$, the activation mechanism 25 moves the distance d, and the plunger member 63 and piston member 74 compress spring 80. This movement of the activation mechanism 25, with reference to FIG. 1B, causes the upper and lower portions 26*a*, 26*b* of the piezoelectric unit 26 to compress together, thereby causing the cam member 32 on the upper portion 26*a* to move, which moves the valve actuator 14 to act on jet and valve assembly 15 to move valve stem 15*a* forward to release the fuel F from compartment 12*a*. When the cam member 32 contacts the valve actuator 14 electrical communication occurs between the piezoelectric unit 26 and a wire (not shown) inside the wand 101. Further depression of the activation mechanism 25 causes a hammer (not shown) within the piezoelectric unit to strike a piezoelectric element (not shown), also within the piezoelectric unit. Striking the piezoelectric element or crystal, produces an electrical impulse that is conducted along wire 28 (as shown in FIG. 1) to wand 101 to the tab to create a spark gap with nozzle 143. An electrical impulse also travels from the cam member 32 to valve actuator 14, then to valve stem 15*a* and then to jet 15*a* then electrode 15*b* and nozzle 143. An electrical arc is generated across the gap between the nozzle 143 and the wand 101, thus igniting the escaping fuel.

In the high-actuation-force mode when the activation mechanism 25 is depressed, the spring 80 has a length D2 (as shown in FIG. 6) less than the length D1 (as shown in FIG. 5). During this mode of operation, the latch member 34 remains substantially in the original position and boss 36*a* does not hinder activation mechanism 25 movement due to its location and forward movement in slot 60.

When the activation mechanism 25 is released, the return spring 30 (as shown in FIG. 1B) within the piezoelectric mechanism 26 and the springs 53 and 80 move or assist in moving the piston member 74, plunger member 63 and activation mechanism 25 into their initial, at rest, positions. Spring 16 (as shown in FIG. 1B) biases valve actuator 14 to close jet and valve assembly 15 and shut off the supply of fuel. This extinguishes the flame emitted by the lighter. As a result, upon release of the activation mechanism 25, the lighter automatically returns to the initial state, where the plunger member 63 remains in the high-actuation-force position (as shown in FIG. 5), which requires a high-actuation-force to actuate the activation mechanism.

The lighter may be designed so that a user would have to possess a predetermined strength level in order to ignite the lighter in the high-actuation-force mode. The lighter optionally may be configured so that a user may ignite the lighter in the high-actuation-force mode with a single motion or a single finger.

Figure 7:
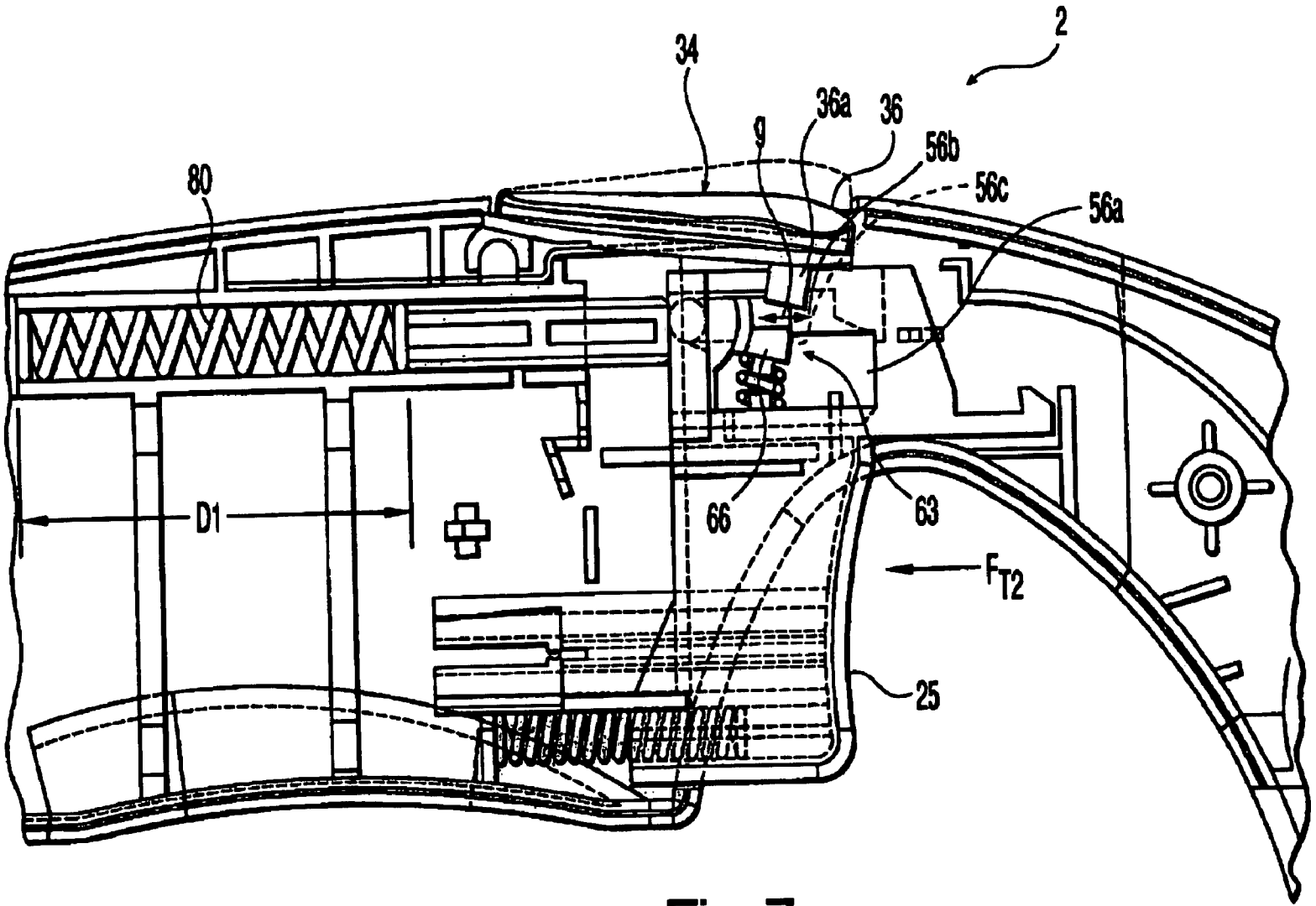
FIG. 7 is an enlarged, partial, side view of the lighter of FIG. 1, where the latch member is depressed, the plunger member is in a low-actuation-force position and the activation mechanism is in the initial position.

Alternatively, if the intended user does not wish to use the lighter by applying a high first activation mechanism force $F_{T1}$ (i.e., the high-actuation-force) to the activation mechanism, the intended user may operate the lighter 2 in the low actuation-force mode (i.e., the low-force mode), as depicted in FIG. 7. This mode of operation comprises multiple actuation movements, and in the embodiment shown, the user applies two motions to directly contact and move two separate components of the lighter for actuation. If the pivotal wand assembly 10 (as shown in FIG. 1) and the cam follower 116 are incorporated into the lighter, operation of the lighter in the low-actuation-force mode may include three motions, including moving the wand assembly to an extended position.

In the lighter of FIG. 7, the low-force mode includes repositioning the plunger member 63 downward such that spring 80 does not oppose motion of the activation mechanism 25 to the same extent as in the high-force mode. In the low-force mode, a force substantially equal to or greater than second activation mechanism force $F_{T2}$ (i.e., a low-actuation-force) is applied to the activation mechanism 25 to ignite the lighter in conjunction with depressing the latch member. In this mode of operation, the second activation mechanism force $F_{T2}$ is preferably less, and optionally significantly less, than the first activation mechanism force $F_{T1}$.

As shown in FIG. 7, to operate the lighter 2 in the low-force mode of this embodiment includes a user pressing and depressing the free end 36 of the latch member 34 from the initial position (shown in phantom) toward the activation mechanism 25 to a depressed position. Due to the operative association between the latch member 34 and the plunger member 63, downward movement of the latch member 34 moves boss 36*a* which in turn moves front end of the plunger member 63 downward. When the latch member 34 and plunger member 63 are in their depressed positions, the recess 70 (as shown in FIG. 3) receives boss 36*a* of latch member and recess 70 provides a horizontal contact surface for the boss in this position.

The latch member may be partially or fully depressed with different results. Depending on the configuration of the lighter components, if latch member is partially depressed, the wall 66*a* may be in contact with or adjacent the vertical wall 56*c*. If the latch member 34 is depressed so that the wall 66*a* is in contact with or adjacent the vertical wall 56*c* of the activation mechanism 25, the lighter 2 is still in the high-force mode. If the latch member 34 is depressed so that the wall 66*a* is equal to or below wall 56*c* the lighter can slip into the low-force mode or is in the low-force mode. In some configurations, the lighter may be designed so that when the latch member 34 is fully depressed, the plunger member 63 is completely out of contact with (e.g., below) upper portion 46 (as shown in FIG. 4) of the activation mechanism 25.

The force applied to the activation mechanism in order to activate the lighter in the low-force mode, i.e., second activation mechanism force $F_{T2}$, at least has to overcome the opposing forces $F_{OP}$ as discussed above to actuate the lighter. In addition, if the plunger member 63 contacts the activation mechanism 25, the second activation mechanism force must also overcome the friction forces generated by this contact during movement of the actuating member. The user, however, may not have to overcome the additional spring force $F_S$ (as shown in FIG. 5) applied by spring 80 depending on whether the user partially or fully depresses the latch member. If partially depressed, the mode of the lighter will depend on whether vertical wall 66*a* is contacting the vertical wall 56*c* or the activation mechanism 25. In case the vertical wall 66*a* contacts the vertical wall 56*c*, the user may still have to overcome the high spring forces due to the extensions 66 still being within the slot portion 56*b*.

Figure 8:
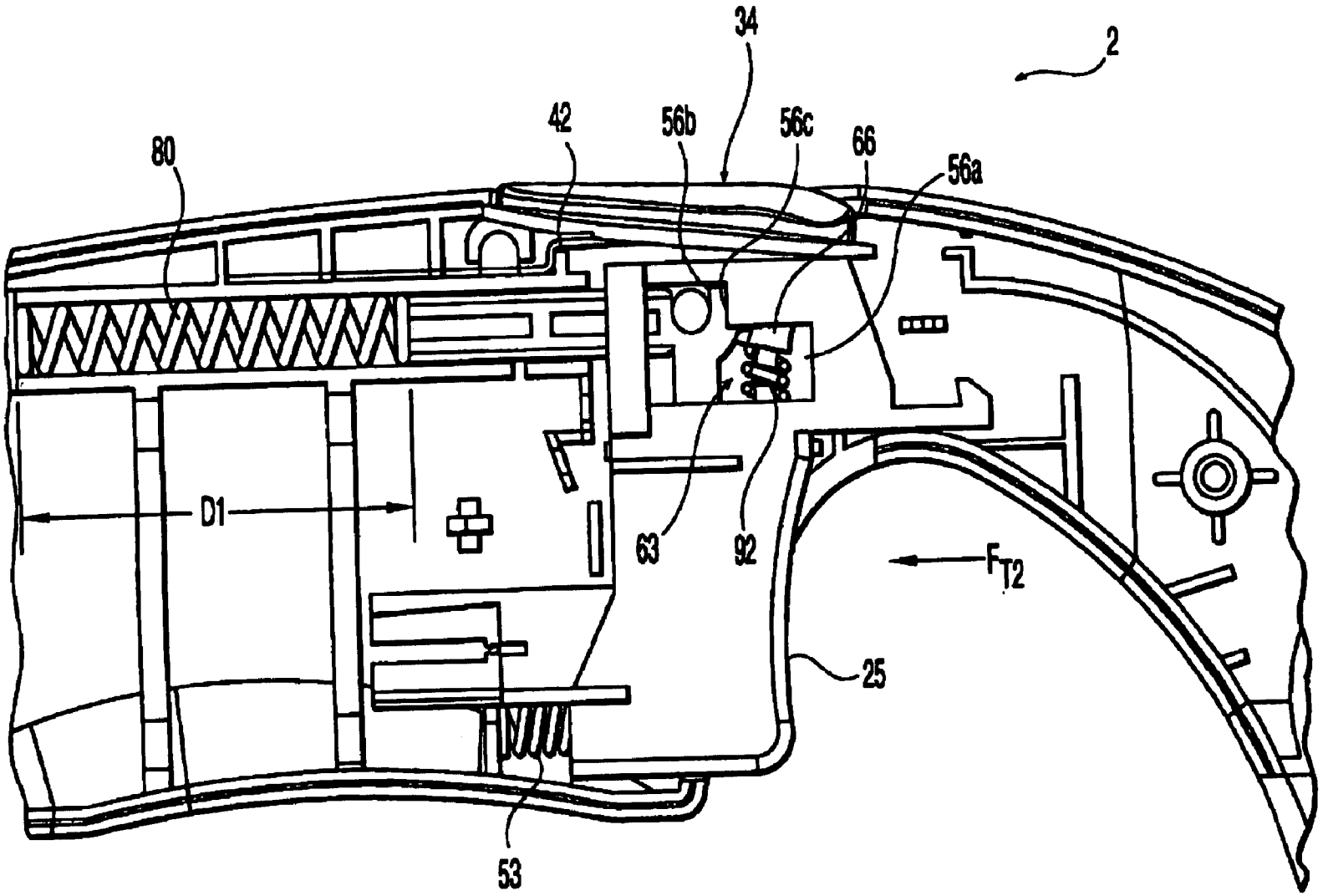
FIG. 8 is an enlarged, partial, side view of the lighter of FIG. 1, where the latch member is depressed, the plunger member is in the low-actuation-force position and the activation mechanism is in the depressed position.

Referring to FIG. 8, in the case where the member 63 contacts the upper surface of the slot portion 56*a*, forces due to contact will have to be overcome. If fully depressed, the user may not have to overcome any spring forces since the wall 66*a* is out contact with wall 56*c*. As a result, the second activation mechanism force $F_{T2}$ required for the low-force mode is less than the first activation mechanism force $F_{T1}$ required for the high-force mode.

In the low-force mode in the lighter as shown in FIG. 8, as the activation mechanism 25 is pressed gap g (shown in FIG. 7) decreases. In addition, as shown in FIG. 8, the spring 80 is not compressed and has its original length D1, piston 74 remains in its original position, spring 53 has been compressed and activation mechanism 25 moves with respect to extensions 66. This allows the lighter to be ignited in the low-force mode. When the activation mechanism 25 and latch member 34 are released, the spring 30 within the piezoelectric mechanism and the return spring 53 move or assist in moving the activation mechanism 25 into its initial position. In addition, the leaf spring 42 and spring 92 move the latch member 34 and the plunger member 63 back to their initial positions. Thus, the lighter automatically returns to the initial position, where the plunger member 63 is in a high-actuation-force position and the lighter requires a high-actuation force to operate.

Figure 10A:
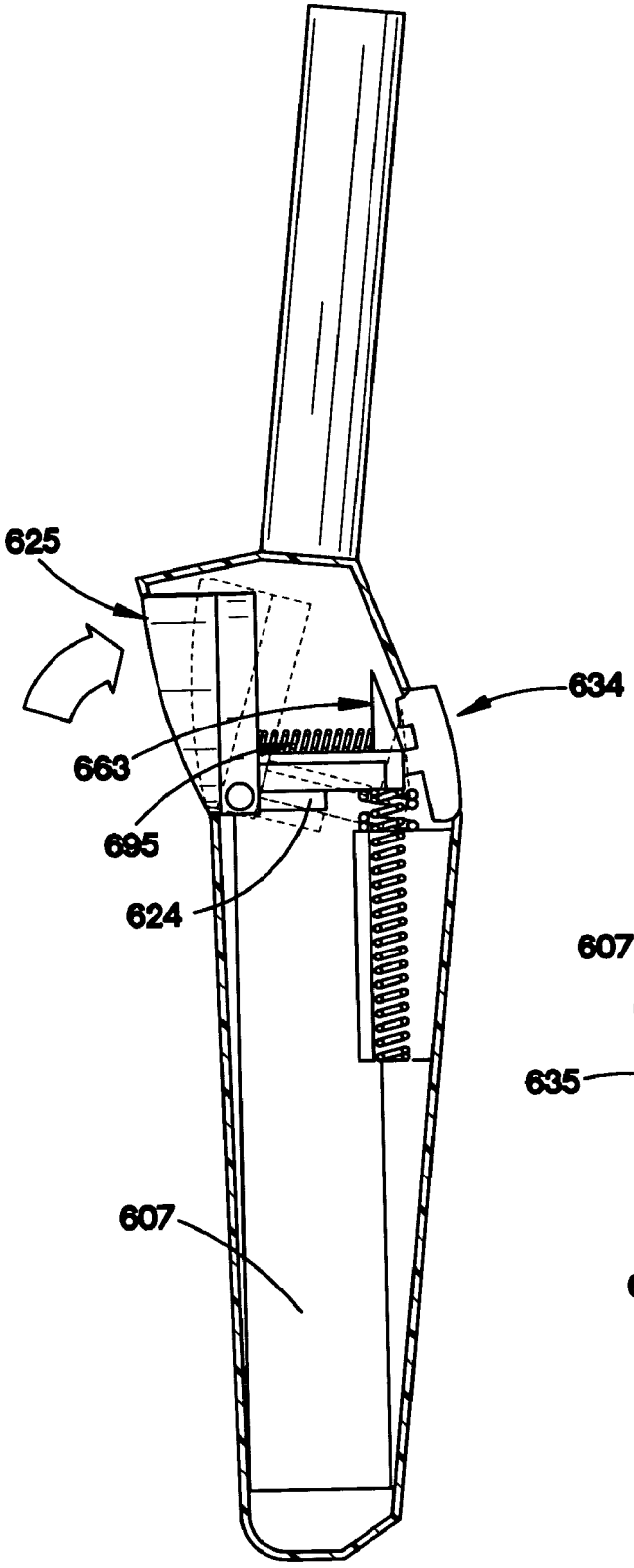
FIG. 10A is a side view of the lighter depicted in FIG. 9, wherein the activation mechanism and latch member are in initial states and the activated state is shown in phantom.
Figure 10B:
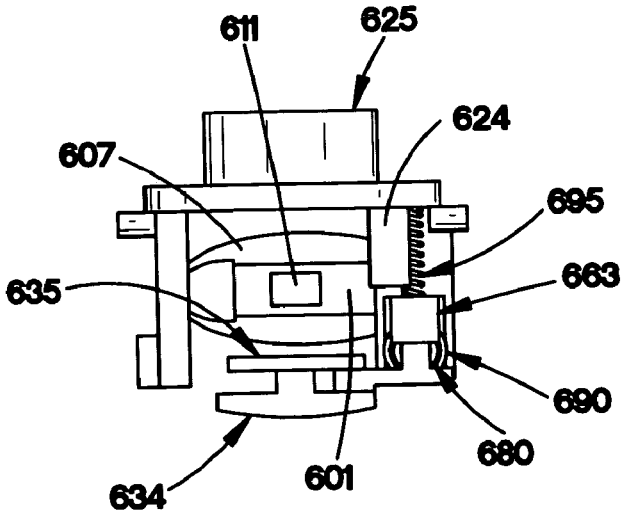
FIG. 10B is a top view of the lighter depicted in FIG. 9, with the latch member in an initial state.
Figure 12:
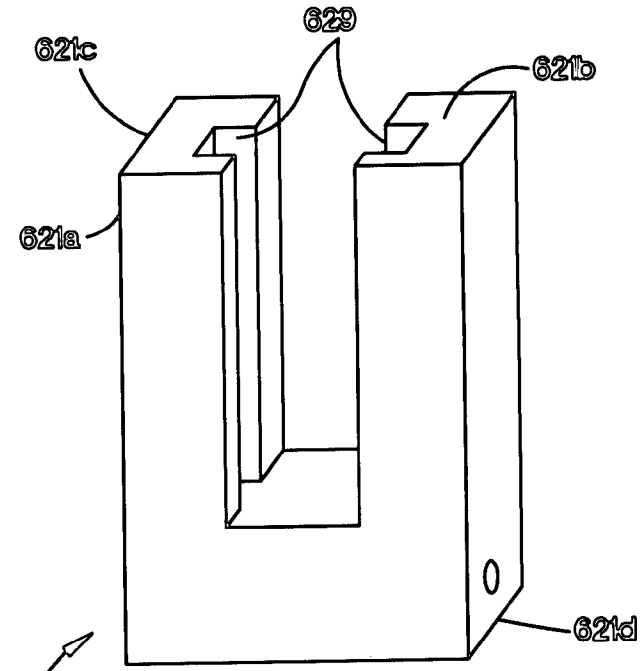
FIG. 12 is a perspective view of the activation mechanism tab of the lighter of FIG. 9.

FIGS. 9, 10, and 10A show an alternative embodiment of lighter 602. Lighter 602 may include a stationary wand 610, an actuating assembly 620, and an ignition system 630. The ignition assembly 630, preferably a piezoelectric unit similar to the one discussed previously, is located to the rear of the activation mechanism 625, relative to the front end 609 of the handle 606 of the lighter 602.

The actuating assembly 620 may include a shaft 623, an actuating tab 622, an activation mechanism tab 621, a gas opening tab 624, and an activation mechanism 625.

Shaft 623 may be fixedly connected to activation mechanism 625. Shaft 623 may also be connected to lighter housing 604. Shaft 623 may be perpendicularly oriented with respect to the front end 609 and rear end 608 of the handle 606, within the lighter 602.

Actuating tab 622 may be rectangular-shaped with one end connected near or about an end 623*a* of shaft 623 and aligned with the ignition assembly 630.

Activation mechanism tab 621 may be connected near or about the other end 623*b* of shaft 623 and aligned with activation mechanism spring 690. Activation mechanism tab 621 may be rectangular-shaped, however, the end 621*c* of the activation mechanism tab 621 not connected to shaft 623 may have a slot through it, forming two posts 621*a*, 621*b*. The slot is sized so that the rear end 671 of the plunger may be located between posts 621*a*, 621*b*. Each post 621*a*, 621*b* may have a channel 629 allowing tabs 668, 669 of plunger member 663 to be positioned in the channel 629 and act as a guide as plunger member 663 moves up and down within the slot of the activation mechanism tab 621. The distance between the post at least preferably is as large as the diameter of the high-actuation-force spring 680, discussed below.

Gas opening tab 624 may be an elongated member which may, for example, be rectangular-shaped and have one end connected to shaft 623 and be aligned with a gas opening member 601 of the gas reservoir 607. The gas opening tab 624 may be located between the actuating tab 622 and the activation mechanism tab 621. The gas opening member 601 of the gas reservoir 607 may have two prongs in the shape of a fork which operate a valve 611 of the gas reservoir 607.

Activation mechanism 625 may include a front end 625*a* and a rear end 625*b*. The rear end 625*b* may be connected to shaft 623 such that the activation mechanism 625 is preferably pivotable about shaft 623. The activation mechanism 625 may also include a lower portion 644 and an upper portion 645. The lower portion 644 includes a downward extending boss 644*a*. The upper portion 645 includes finger actuation surface. For purposes of explanation, the relative term upper or top denotes the surface of the lighter having the activation mechanism 625, whereas the term lower or bottom denotes the surface having the latch member 634.

Activation mechanism tab 621, actuating tab 622, and gas opening tab 624 together with activation mechanism 625 are attached to shaft 623 such that near or about a 90 degree angle is formed between activation mechanism 625 and the three tabs, the activation mechanism tab 621, the actuating tab 622, and the gas opening tab 624.

The activation mechanism 625 is activated by a user depressing the activation mechanism 625 so that it pivots with respect to the lighter housing 604 as shaft 623 rotates about its axis. In this manner, as the activation mechanism 625 is activated, the actuating tab 622 rotates and depresses the ignition assembly, the gas opening tab 624 also rotates depressing the gas opening member 601 of the gas reservoir releasing the gas, and the activation mechanism tab 621 depresses activation mechanism spring 690 (discussed later).

Figure 11:
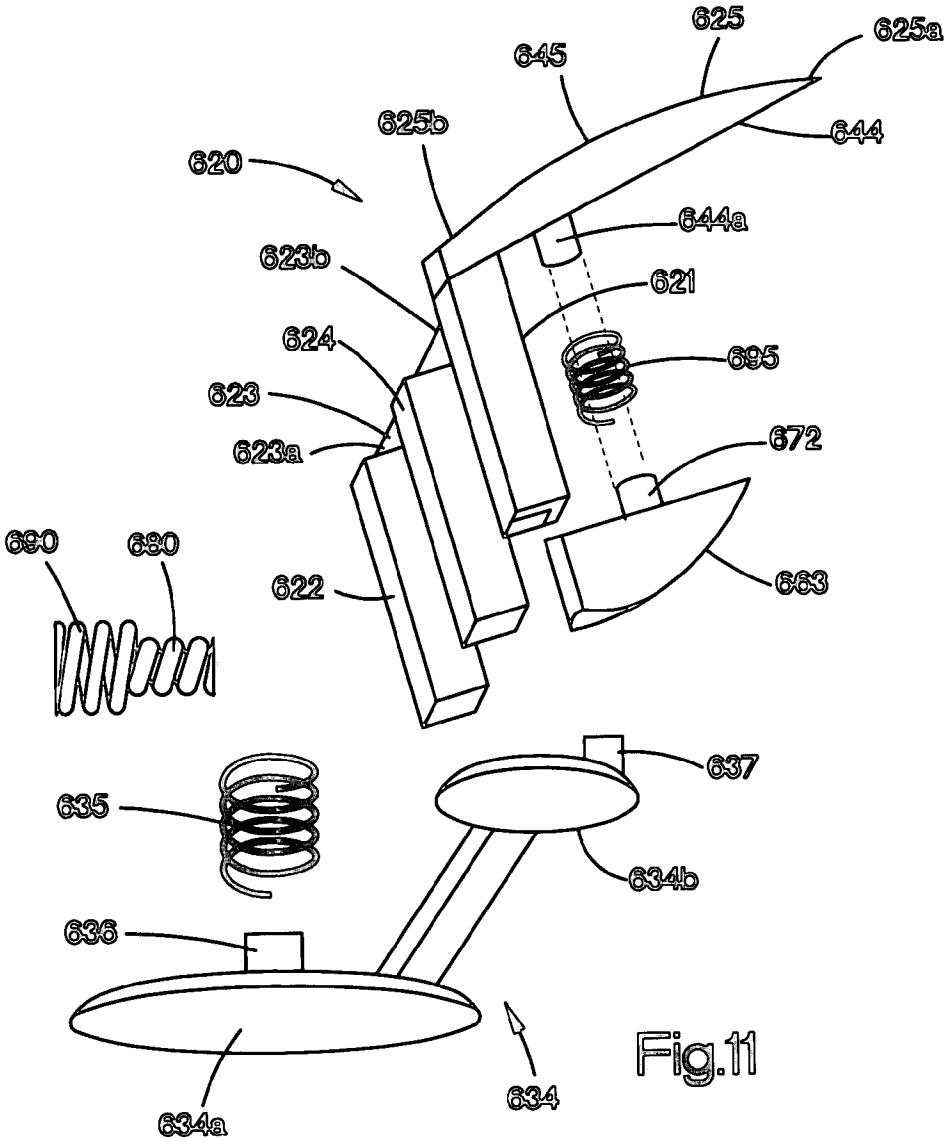
FIG. 11 is an enlarged, exploded, perspective view of various components of the lighter of FIG. 9 without a housing.

Latch member 634 is opposite the actuating assembly 620 near the bottom side of the housing 604. Referring to FIG. 11, the latch member 634 generally includes an upwardly extending boss 636. When the latch member 634 is assembled in the lighter 602, a latch member return spring 635 is position about the boss 636 and against the lighter housing to return the latch member to its at rest or initial position when not depressed by a user.

In this embodiment, the activation mechanism tab 621, the actuating tab 622, and the gas opening tab 624 form a portion of a dual-mode assembly. The dual-mode assembly also includes a plunger member 663.

Figure 13:
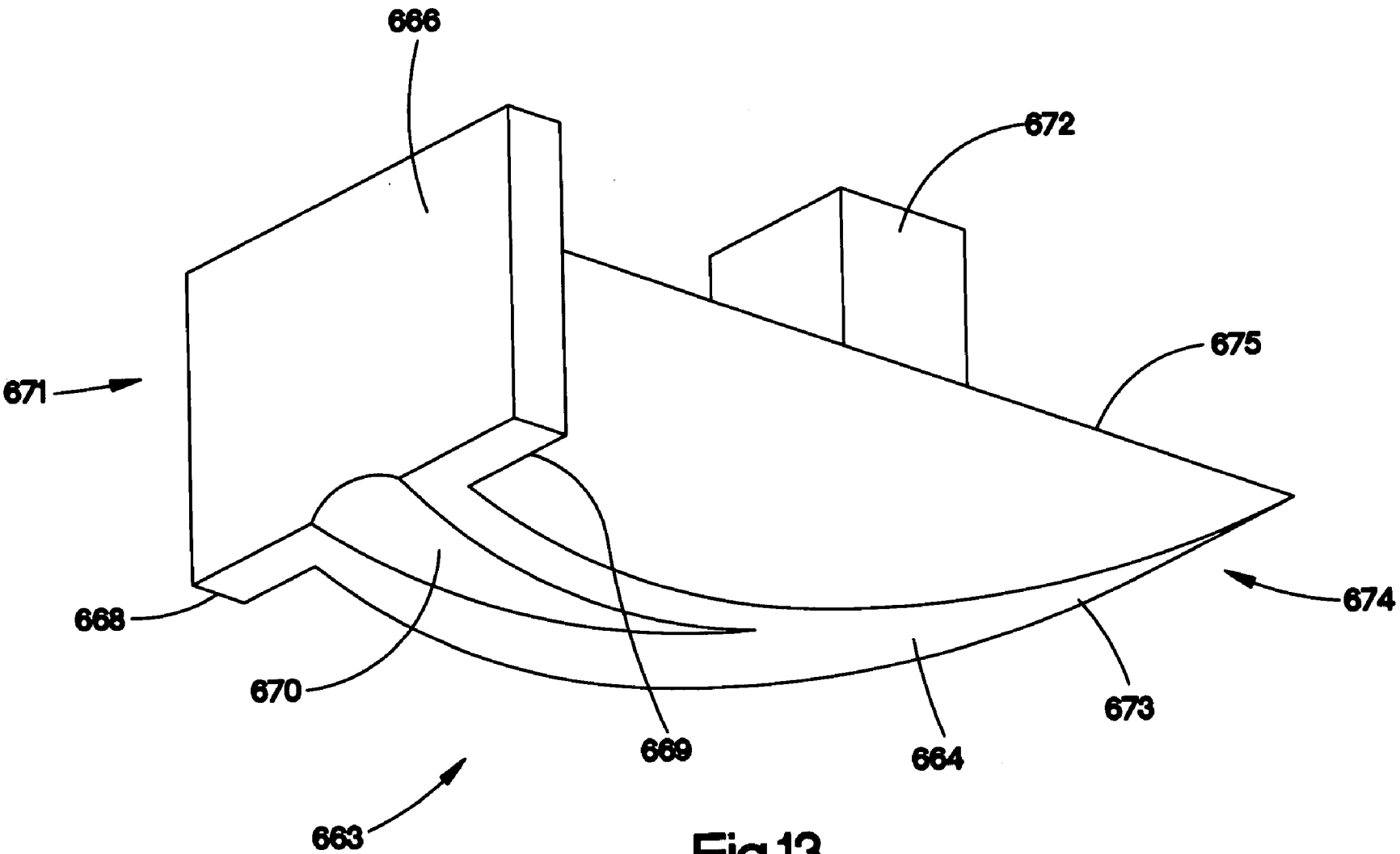
FIG. 13 is a perspective view of the plunger mechanism of the lighter of FIG. 9.

The plunger member 663 when installed in the lighter is disposed internally within the lighter housing 604 and aligned with boss 637 which may be located at one side 634*b* of the latch member 634. The plunger 663 is substantially T-shaped with a longitudinally extending body portion 664 and transversely extending tabs 668, 669. As best seen in FIG. 13, the rear surface 666 of plunger 663 may be planar. Tabs 668, 669 are dimensioned so as to fit in channels 629 of activation mechanism tab 621.

The bottom surface 673 of the body portion 664 of plunger 663 may be convexly shaped. The bottom surface 673 near or at the rear surface 666 may have a groove 670 extending from the rear surface 666 toward the front end 674 of the plunger 663, preferably to approximately the middle of the body portion 664. The groove 670 may have a diameter equal to or larger than the diameter of high-actuation-force spring 680. The plunger member 663 may also include a vertically extending projection 672 that extends from the upper surface 675 of the body portion 664. The projection 672 may cooperate to hold spring 695 in position between the plunger 663 and the activation mechanism 625. Plunger spring 695 may be held in place between the plunger member 663 and the activation mechanism 625 by boss 644*a* on the activation mechanism 625 and projection 672 on the upper side of the plunger member 663.

High-actuation-force spring 680 is positioned within the housing with the rear of the high-actuation-force spring 680 abutting the housing 604. An activation mechanism spring 690, having a diameter larger than the high-actuation-force spring 680 is positioned co-axially over high-actuation-force spring 680, such that the high-actuation-force spring 680 is positioned within the inner circumference of the activation mechanism spring 690, with the front of high-actuation-force spring 680 protruding beyond the front of the activation mechanism spring 690. The activation mechanism spring 690 is positioned within the lighter housing 604 such that one end contacts side ribs 613 and 614 and the other end contacts activation mechanism tab 621. The activation mechanism spring 690 biases the activation mechanism to its at rest position.

Figure 14B:
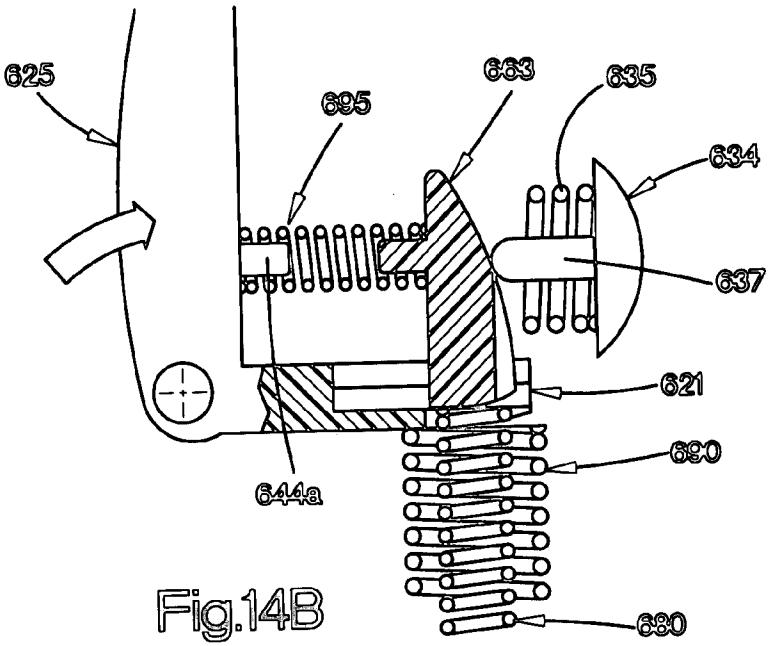
FIGS. 14A-C are a front, side, and top view of various components of the lighter of FIG. 9 in their initial states.
Figure 14A:
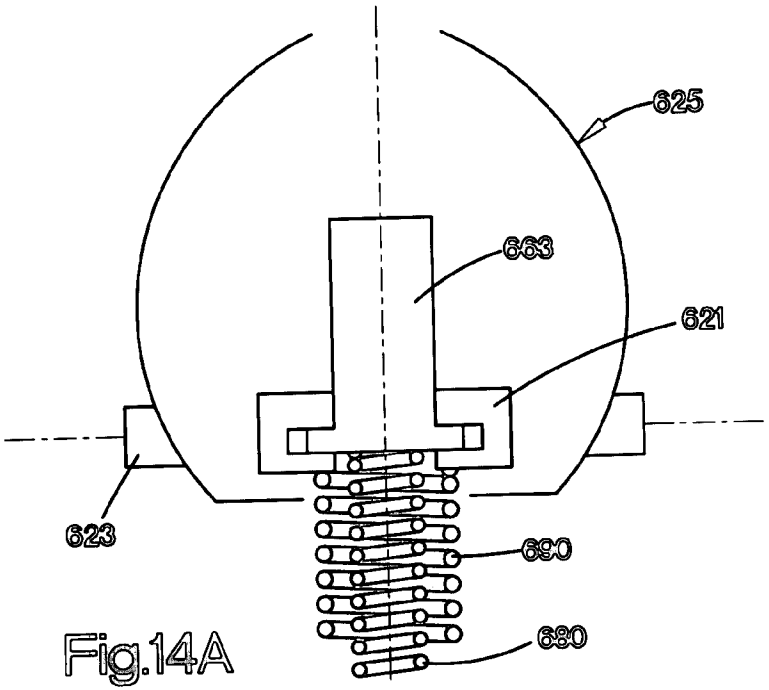
Figure 14C:
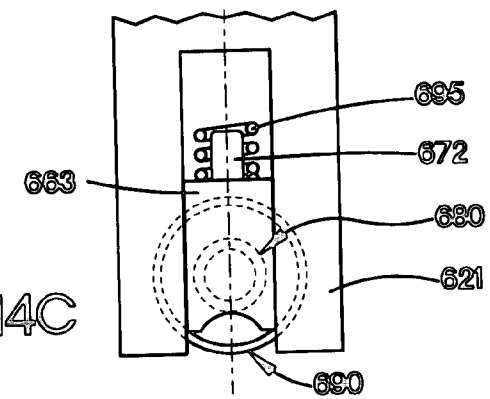

Operation of the lighter 602 in the high-force mode will be describe with reference to FIGS. 14A-C. It should be noted that a user need only use one finger to operate the lighter 602 in the high-force mode. In the high-actuation-force position or at rest position, the plunger member 663 is positioned at or near end 621*c* of activation mechanism tab 621, such that when the activation mechanism 625 is pressed and rotated, activation mechanism tab 621 correspondingly rotates causing the plunger member 663 to rotate with activation mechanism tab 621 to compress high-actuation-force spring 680 and the activation mechanism tab 621 to compress activation mechanism spring 690. Side ribs 613 and 614, from housing 604, prevent the high-actuation-force spring 680 from bending when the plunger member 663 and activation mechanism tab 621 compresses both the high-activation-force spring 680 and the activation mechanism spring 690, respectively. Compression of both the high-actuation-force spring 680 and activation mechanism spring 690 causes a spring force $F_S$ to be exerted against the movement of the activation mechanism tab 621, plunger 663 and activation mechanism 625. In the high-actuation-force mode the latch member 634 remains substantially in its initial or at rest position.

As discussed above, movement of the activation mechanism 625 also causes the actuating tab 622 to rotate. Rotation of the actuating tab 622 causes the upper and lower portions of the piezoelectric unit 630 to compress together (not shown), thereby actuating the piezoelectric unit. For a more complete description of the inner workings of the piezoelectric unit, refer to the earlier disclosure discussing the first embodiment of the present invention. Similarly, movement of the activation mechanism 625 causes the gas opening tab 624 to rotate. Rotation of the gas opening tab 624 causes the gas opening member 601 of the gas reservoir to compress a spring (not shown) and release the gas. It being appreciated that other ignition mechanisms or assemblies may be utilized to ignite the fuel released by the lighter.

When the activation mechanism 625 is released, a return spring (not shown) within the piezoelectric mechanism 630, the spring associated with the gas opening member 601, the high-actuation-force spring 680, and the activation mechanism spring 690 move or assist in moving the activation mechanism tab 621, the actuating tab 622, together with plunger member 663, the gas opening tab 624, and the activation mechanism 625 into their initial, at rest, positions. As a result, upon release of the activation mechanism 625, the lighter automatically returns to the initial state, where the plunger member 663 remains in the high-actuation-force position (as shown in FIG. 14B), which requires a high-actuation-force to actuate the activation mechanism.

The lighter may be designed so that a user would have to possess a predetermined strength level in order to ignite the lighter in the high force mode. Thus, in the high force mode, the user must exert a first activation mechanism force $F_{T1}$ on the activation mechanism 625 to operate the lighter. The first activation mechanism force $F_{T1}$ must be greater than opposing forces $F_{OP}$ which comprise spring force $F_S$, the spring force from the return spring in the piezoelectric unit, the spring force from the spring associated with the gas opening member 601, and any other forces due to springs, biasing members, and friction which are part of or added to the actuating assembly, fuel container and the ignition system.

Figure 15B:
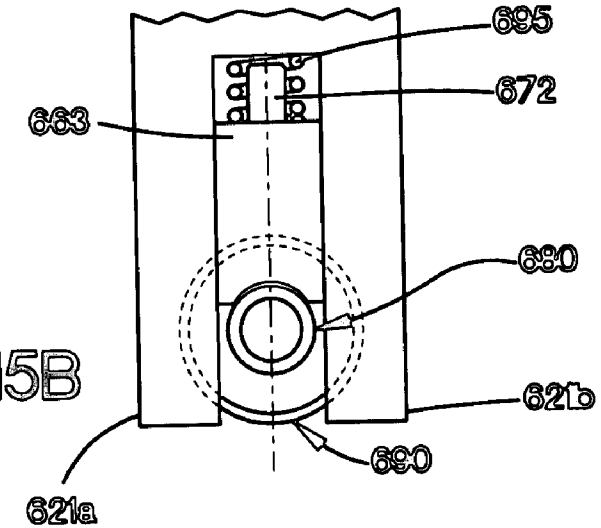
FIGS. 15A and B are a side and top view of various components of the lighter of FIG. 9 in their activated or low-force mode state.
Figure 15A:
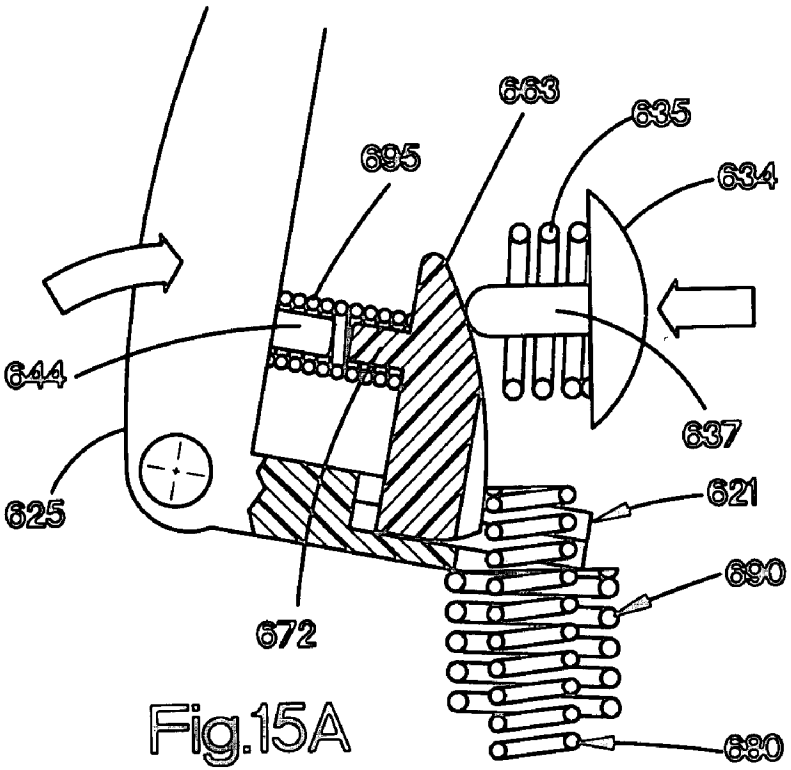

Alternatively, if the intended user does not wish to use the lighter by applying a high first activation mechanism force $F_{T1}$ (i.e., the high-actuation-force) to the activation mechanism 625, the intended user may operate the lighter 602 in the low-actuation-force mode (i.e., the low-force mode), as depicted in FIGS. 15A and 15B. This mode of operation comprises multiple actuation movements, and in the embodiment shown, the user applies two motions to move two components of the lighter for actuation.

The low-force mode includes a user repositioning plunger member 663 upward such that high-actuation-force spring 680 does not oppose motion of the activation mechanism 625. Note that in the low force mode as the activation mechanism 625 is rotated it carries with it the plunger 663, and that boss 637 continues to make contact with and keep plunger 663 from being aligned with the high-actuation-force spring 680. Boss 637 may fit into the another groove (not shown) on the bottom side 673 of plunger 663, preventing the boss 637 from moving laterally, with respect to the front and rear ends of the housing 604, as the plunger 663, in contact with boss 637, is moved with activation mechanism tab 621. The radius of the convexly-shaped bottom surface 673 may be equal to the length of the activation mechanism tab 621, so as to allow even rotation of the activation mechanism tab 621. In the low-force mode, a force substantially equal to or greater than second activation mechanism force $F_{T2}$ (i.e., a low-actuation-force) is applied to the activation mechanism 625 to ignite the lighter in conjunction with the movement of the latch member 634. In this mode of operation, the second activation mechanism force $F_{T2}$ is preferably less, and optionally significantly less, than the first activation mechanism force $F_{T1}$.

To operate the lighter 602 in the low-force mode includes pressing the latch member 634 from the initial position (shown in FIG. 14B) into the body of the lighter 602 to a second position (shown in FIG. 15A). The latch member 634 moves in a linear direction when a user applies a force thereto. Due to the operative association between the latch member 634 and the plunger member 663, movement of the latch member 634 moves boss 637 which in turn moves the plunger member 663 within the slots of activation mechanism tab 621 towards end 621*d* of the activation mechanism tab 621. The plunger member 663 is moved to a position away from the end 621*c* of the activation mechanism tab 621 so that it is no longer aligned with the high-actuation-force spring 680. When the activation mechanism 625 is pressed and rotated the activation mechanism tab 621 correspondingly rotates. As the activation mechanism tab 621 is further rotated, the high-actuation-force spring 680 passes through the two posts 621*a*, 621*b*. The two posts 621*a*, 621*b*, however, engage the activation mechanism spring 690, but not the high-actuation-force spring 680.

To actuate the lighter 602 in this low-force mode, a user applies at least a second activation mechanism force $F_{T2}$ to the activation mechanism 625 which is substantially equal to or greater than the sum of the activation mechanism spring force $F_{S2}$ and all additional opposing forces $F_{OP}$. The activation mechanism spring force $F_{S2}$ may comprise the force necessary to compress the activation mechanism spring 690, but not the force to compress high-actuation-force spring 680. The opposing forces $F_{OP}$ may comprise the forces applied by the various other elements and assemblies which are moved and activated in order to operate the lighter, such as the spring force from the return spring in the piezoelectric unit applied against the actuating tab 622, the frictional force between the plunger member 663 and the boss 637 caused by the movement of the plunger member 663, the spring force from the spring associated with the gas opening member 601, and any other forces due to springs and biasing members which are part of or added to the actuating member or actuating assembly, fuel container, or which are overcome to actuate the lighter. In the low-actuation-force position, a lower activation mechanism force than in the high-actuation-force position is preferable to ignite the lighter because high-actuation-force spring 680 is not engaged with the plunger member 663.

If the latch member 634 is partially pressed, the mode of the lighter will depend on whether the rear surface 666 of the plunger member 663 contacts the high-actuation-force spring 680 when the activation mechanism 625 is pressed. In the case where the rear surface 666 contacts the high-actuation-force spring 680, the user may still have to overcome the high spring forces of the high-actuation-force spring 680, where the lighter 602 is still in the high-force mode.

Upon release of the latch member 634, the latch member 634 returns to its initial or at rest position due to latch member spring 635. The plunger member 663 will also return to its initial or at rest position, if the activation mechanism 625 has been released, due to plunger spring 695. Thus, the lighter automatically returns to the initial position, where the plunger member 663 is in a high-actuation-force position and the lighter requires a high-actuation force to operate.

Preferably, in order to perform the low-force mode, the user has to possess a predetermined level of dexterity and cognitive skills so that depression of the latch member and movement of the activation mechanism are carried out in the correct sequence. In the low-force mode, a user may use one finger to press latch member and a different finger to apply the activation mechanism force. The lighter may be designed so that the activation mechanism force preferably is applied after the latch member is depressed so that a proper sequence is carried out to operate the lighter. Alternatively, another sequence can be used for actuation, and the present invention is not limited to the sequences disclosed but also includes such alternatives as contemplated by one of ordinary skill in the art. For example, the sequence can be moving/pivoting the activation mechanism partially, depressing the latch member, and then moving/pivoting the activation mechanism the rest of the way. The lighter in the low-force mode also may rely on the physical differences between intended and unintended users, for example, by controlling the spacing of the activation mechanism and the latch member, or adjusting the operation forces, or shape and size of the latch member, activation mechanism or lighter.

In order to make the lighter so that it is not excessively difficult for some intended users to actuate, the high-actuation force $F_{T1}$ preferably should not be greater than a predetermined value. It is contemplated that for the lighter, the preferred value for $F_{T1}$ is less than about 10 kg and greater than about 5 kg, and more preferably less than about 8.5 kg and greater than about 6.5 kg. It is believed that such a range of force would not substantially negatively affect use by some intended users, and yet would provide the desired resistance to operation by unintended users. These values are exemplary and the operative force in the high-force mode may be more or less than the above ranges.

One of ordinary skill in the art can readily appreciate that various factors can increase or decrease the high-actuation force which an intended user can comfortably apply to the activation mechanism. These factors may include, for example, the leverage to pull or actuate the activation mechanism provided by the lighter design, the friction and spring coefficients of the lighter components, the activation mechanism configuration, the complexity of the activation mechanism actuation motion, the location, size and shape of the components, intended speed of activation, and the characteristics of the intended user. For example, the location and/or relationship between the activation mechanism and the latch member and whether the intended user has large or small hands.

The design of the internal assemblies, for example the configuration of the actuating assembly, the configuration of any linking mechanism, as discussed below, the number of springs and forces generated by the springs all affect the force which a user applies to the activation mechanism in order to operate the lighter. For example, the force requirements for an activation mechanism which moves along a linear actuation path may not equal the force requirements to move an activation mechanism along a non-linear actuation path. Actuation may require that a user move the activation mechanism along multiple paths which may make actuation more difficult. While the embodiments disclosed have shown the preferred activation mechanism with linear and non-linear actuation paths, one of ordinary skill in the art can readily appreciate that other non-linear actuation paths are contemplated by the present invention.

In the illustrated embodiments, the second activation mechanism force $F_{T2}$ for the low-force mode is less than the first activation mechanism force, preferably, but not necessarily, by at least about 2 kg. Preferably, the low-actuation force $F_{T2}$ is less than about 5 kg but greater than about 1 kg, and more preferably greater than about 3.0 kg. These values are exemplary, as discussed above, and the present invention is not limited to these values as the particular desirable values will depend upon the numerous lighter design factors outlined above and the desired level of resistance to operation by unintended users.

One feature of the lighter is that in the high-force mode multiple actuating operations may be performed so long as the user provides the necessary actuation force. Another feature of the lighter is that in the low-force mode multiple actuating operations may be performed so long as the user depresses the latch member and provides the necessary actuation force and motions required to ignite the lighter. In particular, if the lighter does not operate on the first attempt, the user may re-attempt to produce a flame by actuating the activation mechanism again in the low-force mode if the user continues to depress the latch member.

While various descriptions of the present invention are described above, it should be understood that the various features of each embodiment may be used singularly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. For example, insulated wire 28 (shown in FIG. 1B) may be replaced by an at least partially helically coiled spring concentrically disposed outside of conduit 23. As another example, the wand assembly may be configured to pivot about an axis with respect to housing, to move or slide with respect to housing or to be fixed with respect to the housing. These modifications may require additional modifications, as known by those of ordinary skill in the art, to complete the electrical communication between the piezoelectric unit and the nozzle. As yet another example, in all of the embodiments, the latch member can be used with or without a separate biasing member for returning the latch member to its initial position after depression. When a separate biasing member is not used, it is recommended that the latch member by resiliently deformable.

Moreover, while the lighter, described herein have used an activation mechanism to simultaneously operate both the actuating mechanism or actuating assembly and the ignition mechanism or ignition assembly, the lighter may provide separate user operated mechanisms or assemblies so that the fuel is released independent and separate from the operation of the ignition mechanism or ignition assembly.

Furthermore, although in the presently discussed embodiments the low-force mode relies on the user operating two components, in an alternative embodiment, the low-force mode may rely on the user operating a number of components.

As another example, the plunger member in any of the embodiments above may be configured and located so that a finger actuation portion of the plunger member is outside of the housing and the remainder of the plunger member is within the housing. Thus, the plunger member may be moved from the high-actuation-force position to the low-actuation force position by a user contacting the finger actuation portion of the plunger member. In such an embodiment, the lighter may not include a latch member.

Furthermore, the lighter may include the dual-mode aspect of the lighter, a pivoting wand assembly aspect of the lighter, a cam follower aspect of the lighter, and a conduit aspect of the lighter, separately or in any combination. As a result, the features of the lighter can be used alone or in combination with one another or other known features.

Accordingly, all expedient modifications readily attainable by one versed in the art from the disclosure set forth herein which are within the scope and spirit of the present invention are to be included as further embodiments of the present invention. Moreover, the features of the embodiments may be combined with additional cognitive effects such as a more complex activation mechanism actuation path to make actuation of the lighter more difficult. The scope of the present invention is accordingly defined as set forth in the appended claims.

The invention claimed is:

1. A lighter comprising:

a housing having a supply of fuel;

an igniting assembly for igniting released fuel;

an actuating assembly that includes an actuating member pivotably connected to the housing for performing at least one step in igniting the fuel;

a plunger member operatively associated with the latch member;

at least two biasing members, a first biasing member always operatively associated with the actuating assembly and a second biasing member selectively operatively associated with the plunger member; and a latch member moveable by a user between a first latch member position and a second latch member position, wherein the user applies a first actuating force to the actuating member to ignite the fuel when the latch member is positioned in the first latch member position, and a second actuating force to the actuating member to ignite the fuel when the latch member is positioned in the second latch member position, the first actuating force being greater than the second actuating force.

2. The lighter according to claim 1, wherein a predetermined actuating force is necessary to move the actuating member to an actuation position to actuate the lighter, when the latch member is in the first latch member position and the first actuating force is greater than the predetermined actuating force.

3. The lighter according to claim 1, wherein the latch member moves in a linear direction when the user applies a force thereto.

4. The lighter according to claim 1, wherein the actuating member is an activation mechanism having a surface exterior to the lighter housing which is pivotably coupled to the housing.

5. The lighter according to claim 1, wherein in the first latch position a surface of the latch member protrudes from beyond the housing, and in the second latch position the surface of the latch member is located within the housing.

6. The lighter according to claim 1, wherein when the latch member is in the first latch member position and the first actuating force is applied to the actuating member, the plunger member compresses the first biasing member and the actuating assembly compresses the second biasing member and the lighter is actuated.

7. The lighter according to claim 1, wherein when the latch member is in the second latch member position and the second actuating force is applied to the actuating member, the actuating assembly compresses the first biasing member, the plunger member does not compress the second biasing member when the actuating assembly is pivoted within the housing.

8. The lighter according to claim 1, wherein actuating the lighter is accomplished by movement of the latch member and the actuating assembly.

9. The lighter according to claim 1, wherein the igniting assembly comprises a piezoelectric unit.

10. The lighter according to claim 1, wherein the actuating member selectively dispenses the fuel and activates the igniting assembly.

11. The lighter according to claim 1, wherein the actuating assembly further includes an activation mechanism tub, an actuating tab, and a gas opening tab.

12. The lighter according to claim 11, wherein the plunger member is carried by and slidably associated with activation mechanism tab.

13. The lighter according to claim 1, wherein actuation of the lighter when the latch member is in the first latch member position requires a single finger of a user.

14. The lighter according to claim 1, wherein actuation of the lighter when the latch member is in the second latch member position may entail use of a first and second finger, preferably of the same hand, of the user.

15. The lighter according to claim 1, wherein the lighter is configured and adapted to operate by moving the latch member before moving the actuating member.

16. The lighter according to claim 1, wherein the lighter is configured and adapted to operate by relying on the physical characteristics of a user when the latch member is in the first latch member position.

17. The lighter according to claim 1, wherein the lighter has a wand that extends from the housing of the lighter that contains a nozzle to release the fuel, and wherein the wand is at least 2 inches long.

18. A lighter comprising:

a housing having a supply of fuel;

an actuating assembly for selectively releasing the fuel, wherein the actuating assembly includes an actuating member pivotably connected to the housing;

an ignition assembly for igniting the released fuel;

a latch member movable in a linear direction to permit movement between a first latch position and a second latch position;

a plunger member operatively associated with the latch member;

a first biasing member operatively associated with the actuating assembly; and a second biasing member operatively associated with the plunger member, wherein at least a portion of the plunger member is repositioned by the latch member from a first member position which causes the first biasing member and second biasing member to resist movement of the actuating member to a second member position so that the second biasing member does not resist movement of the actuating member, and wherein the actuating member is movable to ignite the released fuel when the plunger member is in the first member position and when the plunger member is in the second member position.

* * * * *